US006405007B1

(12) United States Patent
Aita et al.

(10) Patent No.: US 6,405,007 B1
(45) Date of Patent: Jun. 11, 2002

(54) MAGNETIC PARTICLES FOR CHARGING, PROCESS FOR PRODUCING THE MAGNETIC PARTICLES, AND CHARGING MEMBER, PROCESS CARTRIDGE AND IMAGE-FORMING APPARATUS WHICH HAVE THE MAGNETIC PARTICLES

(75) Inventors: Shuichi Aita, Mishima; Fumihiro Arahira, Shizuoka-ken; Kiyoshi Mizoe, Numazu, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/592,548

(22) Filed: Jun. 12, 2000

(30) Foreign Application Priority Data

Jun. 11, 1999 (JP) ..... 11-165966
Jun. 11, 1999 (JP) ..... 11-165967

(51) Int. Cl.[7] ..... G03G 13/02; G03G 15/02

(52) U.S. Cl. ..... 399/174; 399/168; 430/111.3; 430/111.35; 430/111.4

(58) Field of Search ..... 399/168, 175, 399/174, 267; 430/106.6, 108, 111, 111.3, 111.31, 111.32, 111.35, 111.4; 361/221, 225

(56) References Cited

U.S. PATENT DOCUMENTS

| | | | | |
|---|---|---|---|---|
| 4,174,903 A | * | 11/1979 | Snelling | 399/168 X |
| 5,766,814 A | * | 6/1998 | Baba et al. | 430/111.32 |
| 5,835,821 A | * | 11/1998 | Suzuki et al. | 399/174 X |
| 6,042,982 A | * | 3/2000 | Hakata | 430/108 |
| 6,157,801 A | * | 12/2000 | Aita et al. | 399/175 |

FOREIGN PATENT DOCUMENTS

| | | |
|---|---|---|
| EP | 0689103 | 12/1995 |
| EP | 0790535 | 8/1997 |
| EP | 0889369 | 1/1999 |
| EP | 0892319 | 1/1999 |
| JP | 133569 | 7/1984 |
| JP | 295115 | 10/1994 |
| JP | 317969 | 11/1994 |
| JP | 6355 | 1/1996 |
| JP | 69149 | 3/1996 |

OTHER PUBLICATIONS

Brandrup, Et Al. "Polymer Handbook", 2nd Edition. Published by John Wiley & Sons, N.Y. pp. (III–139) to (III–192). The Glass Transition Temperatures of Polymers.

* cited by examiner

*Primary Examiner*—Sophia S. Chen
(74) *Attorney, Agent, or Firm*—Fitzpatrick, Cella, Harper & Scinto

(57) ABSTRACT

Magnetic particles for charging an image-bearing member electrostatically. The charging magnetic particles have magnetic particles, first surface coat layers containing a first surface coating agent and covering the surfaces of the magnetic particles and second surface coat layers containing a second surface coating agent and covering the first surface coat layers. The charging magnetic particles contain magnetic particles for charging which have a maximum chord length of 5 μm or larger, and the magnetic particles for charging which have a maximum chord length of 5 μm or larger having a minor-axis length/major-axis length standard deviation of 0.08 or more. Also, a process for producing the charging magnetic particles is disclosed together with a charging member, a process cartridge and an image forming apparatus which make use of the charging magnetic particles.

63 Claims, 6 Drawing Sheets

MAGNETIC PARTICLES FOR CHARGING, PROCESS FOR PRODUCING THE MAGNETIC PARTICLES, AND CHARGING MEMBER, PROCESS CARTRIDGE AND IMAGE-FORMING APPARATUS WHICH HAVE THE MAGNETIC PARTICLES

BACKGROUND OF THE INVENTION

1. Field of the Invention

This invention relates to magnetic particles for charging which electrostatically charge an image-bearing member used in recording processes that utilize electrophotography, applicable in copying machines, printers and facsimile machines. It also relates to a process for producing such magnetic particles, and a charging member, a process cartridge and an image-forming apparatus which have the magnetic particles.

2. Related Background Art

A number of methods are conventionally known as electrophotography. Copies or prints are commonly obtained by forming an electrostatic latent image on a photosensitive member by utilizing a photoconductive material and by various means, subsequently developing the latent image by the use of a toner to form a visible image as a toner image, transferring the toner image to a transfer medium such as paper as occasion calls, and thereafter fixing the toner image to the transfer medium by heat and/or pressure. Toner particles that have not transferred to the transfer medium and have remained on the photosensitive member are removed from the photosensitive member through a cleaning step.

As means for charging the photosensitive member in such electrophotography, charging methods are available which utilizes corona discharging, called corotron or scorotron. Also, charging methods in which a charging member such as a roller, a fur brush or a blade is brought into contact with the photosensitive member surface to effect discharging in a narrow space in the vicinity of the contact area so as to cause ozone as less as possible have been brought forth and have been put into practical use.

In the charging method utilizing corona discharging, however, electrophotographic apparatus must be provided with a filter for capturing ozone, since ozone is generated in a large quantity especially when negative or positive corona is formed. This has involved problems that the apparatus have a large size and require a high running cost. Also, the method in which the charging member such as a blade or a roller is brought into contact with the photosensitive member to effect charging tends to cause problems that the toner melt-adheres onto the photosensitive member.

Accordingly, a method is also studied in which the charging member is used in the state it is only set close to the photosensitive member to avoid direct contact. Members for charging photosensitive members include the above roller, blade and brush, or members comprising a slender conductive plate-like material provided with a resistance layer. However, the charging carried out using any of such members has a problem that the distance between the charging member and the photosensitive member can be controlled with difficulty, and has been difficult to bring into practical use.

Accordingly, a technique is also studied in which what is called a magnetic brush is used as a charging member, which may apply a relatively small load to the photosensitive member during contact and holds magnetic particles with a magnet member. As charging methods making use of magnetic particles, two methods are proposed in combination of photosensitive members. One of them is a method in which a charge injection layer is provided as a surface layer of the photosensitive member and electric charges are directly injected through contact with this charge injection layer to charge the photosensitive member electrostatically. The other is a method in which an ordinary photosensitive member is used and discharging at microscopic gaps between magnetic particles and the surface of the photosensitive member is utilized.

With regard to magnetic particles used as a charging member, Japanese Patent Application Laid-open No. 59-133569 discloses that magnetic particles are coated with iron powder to make adjustment of resistance; and Japanese Patent Application Laid-open No. 6-295115, that resin layers containing conductive particles are formed on magnetic particle surfaces to make improvement for making environmental dependency of resistivity small and making magnetic particle surfaces less contaminable. Japanese Patent Application Laid-open No. 8-6355 further discloses a proposal that the running performance (durability) of a charging member is improved by mixing magnetic particles having smooth surfaces and magnetic particles having uneven surfaces, and Japanese Patent Application Laid-open No. 8-69149 discloses that magnetic particles having particle size distribution with a plurality of peaks are used to prevent the magnetic particles from surface contamination to achieve a long-term charging stability.

Techniques of applying a magnetic-brush charging assembly in the formation of full-color images are also disclosed. For example, Japanese Patent Application Laid-open No. 6-317969 discloses an apparatus having yellow, cyan, magenta and black developing assemblies for one photosensitive member and charging the photosensitive member through a magnetic brush. This, however, does not disclose any preferable magnetic particles at all in relation to the formation of color images.

As discussed above, in respect of magnetic particles serving as a charging member for charging photosensitive members, it is desired for them to be constituted more preferably. Also, in recent years, with progress of image input-output, processing and display techniques, hard copying/printing techniques which can be more simple and low-cost are desired, in the course of which away of solution is sought also on problems peculiar to instances where the magnetic particles are used and full-color images are formed.

As stated above, it is required to bring forth magnetic particles for charging that are more preferably constituted as a charging member. More specifically, it is sought to provide magnetic particles having stable charging performance and durable to long-term service when a charging assembly making use of magnetic particles for charging is continuously used, and also to provide a charging member, a process cartridge and an image-forming apparatus which employ such magnetic particles. In the formation of full-color images, too, it is sought to provide magnetic particles that can contribute to the formation of sharp images over a long period of time, and also to provide a charging member, a process cartridge and an image-forming apparatus which employ such magnetic particles.

SUMMARY OF THE INVENTION

The present invention was made from the above point of view. Accordingly, an object of the present invention is to provide magnetic particles for charging which have a superior service durability, and a charging member, a process cartridge and an image-forming apparatus which employ such magnetic particles.

Another object of the present invention is to provide a process cartridge and an image-forming apparatus which are less causative of abrasion of photosensitive members.

Still another object of the present invention is to provide magnetic particles for charging which can contribute to the formation of sharp images over a long period of time in the formation of full-color images, too, and a charging member, a process cartridge and an image-forming apparatus which employ such magnetic particles.

A further object of the present invention is to provide a process for producing magnetic particles for charging which have a superior service durability, are less causative of abrasion of photosensitive members and can contribute to the formation of full-color images stable over a long period of time.

To achieve the above objects, the present invention provides magnetic particles for charging which are to be rubbed against an image-bearing member on which an electrostatic latent image is to be formed, to charge the image-bearing member electrostatically; the magnetic particles for charging comprising;

magnetic particles;

first surface coat layers containing a first surface coating agent and covering the surfaces of the magnetic particles; and second surface coat layers containing a second surface coating agent and covering the surfaces of the magnetic particles covered with the first surface coat layers;

the magnetic particles for charging containing magnetic particles for charging which have a maximum chord length of 5 $\mu$m or larger, and the magnetic particles for charging which have a maximum chord length of 5 $\mu$m or larger having a minor-axis length/major-axis length standard deviation of 0.08 or more.

The present invention also provides a process for producing magnetic particles for charging which are to be rubbed against an image-bearing member on which an electrostatic latent image is to be formed, to charge the image-bearing member electrostatically; the process comprising the steps of;

preparing magnetic particles by pulverization;

coating the pulverized magnetic particles with a first surface coating agent to form first surface coat layers on their surfaces; and coating the magnetic particles on which the first surface coat layers have been formed, with a second surface coating agent to form second surface coat layers on the former's surfaces.

The present invention also provides a charging member which is to be rubbed against an image-bearing member on which an electrostatic latent image is to be formed, to charge the image-bearing member electrostatically; the charging member comprising a magnet member having a conductor to which a voltage is to be applied, and magnetic particles for charging which are held on the magnet member by the action of magnetism;

wherein the magnetic particles for charging comprise;

magnetic particles;

first surface coat layers containing a first surface coating agent and covering the surfaces of the magnetic particles; and second surface coat layers containing a second surface coating agent and covering the surfaces of the magnetic particles covered with the first surface coat layers;

the magnetic particles for charging containing magnetic particles for charging which have a maximum chord length of 5 $\mu$m or larger, and the magnetic particles for charging which have a maximum chord length of 5 $\mu$m or larger having a minor-axis length/major-axis length standard deviation of 0.08 or more.

The present invention still also provides a process cartridge which is detachably mountable on an image-forming apparatus in which an electrostatic latent image formed on an image-bearing member is rendered visible by the use of a toner and a toner image formed by rendering the electrostatic latent image visible is transferred to a transfer medium to form an image; the process cartridge comprising;

a charging means for charging the image-bearing member electrostatically by bringing a charging member into contact with the image-bearing member; the charging member comprising a magnet member having a conductor to which a voltage is to be applied, and magnetic particles for charging which are held on the magnet member by the action of magnetism; and at least one means selected from the group consisting of i) the image-bearing member on which the electrostatic latent image is to be formed, ii) a developing means for rendering the electrostatic latent image formed visible by the use of a toner, and iii) a cleaning means for removing the toner, remaining on the image-bearing member after the toner image formed by rendering the electrostatic latent image visible has been transferred to the transfer medium;

wherein the magnetic particles for charging comprise;

magnetic particles;

first surface coat layers containing a first surface coating agent and covering the surfaces of the magnetic particles; and second surface coat layers containing a second surface coating agent and covering the surfaces of the magnetic particles covered with the first surface coat layers;

the magnetic particles for charging containing magnetic particles for charging which have a maximum chord length of 5 $\mu$m or larger, and the magnetic particles for charging which have a maximum chord length of 5 $\mu$m or larger having a minor-axis length/major-axis length standard deviation of 0.08 or more.

The present invention further provides an image-forming apparatus comprising;

an image-bearing member on which an electrostatic latent image is to be formed;

a charging means for charging the image-bearing member electrostatically by bringing a charging member into contact with the image-bearing member; the charging member comprising a magnet member having a conductor to which a voltage is to be applied, and magnetic particles for, charging which are held on the magnet member by the action of magnetism;

an exposure means for exposing to light the surface of the image-bearing member charged by the charging means, to form an electrostatic latent image;

a developing means for rendering the electrostatic latent image formed visible by the use of a toner to form a toner image; and a transfer means for transferring the toner image formed, to a transfer medium;

wherein the magnetic particles for charging comprise;

magnetic particles;

first surface coat layers containing a first surface coating agent and covering the surfaces of the magnetic particles; and second surface coat layers containing a second surface coating agent and covering the surfaces of the magnetic particles covered with the first surface coat layers;

the magnetic particles for charging containing magnetic particles for charging which have a maximum chord length of 5 μm or larger, and the magnetic particles for charging which have a maximum chord length of 5 μm or larger having a minor-axis length/major-axis length standard deviation of 0.08 or more.

DESCRIPTION OF THE PREFERRED EMBODIMENTS

Figure 1:
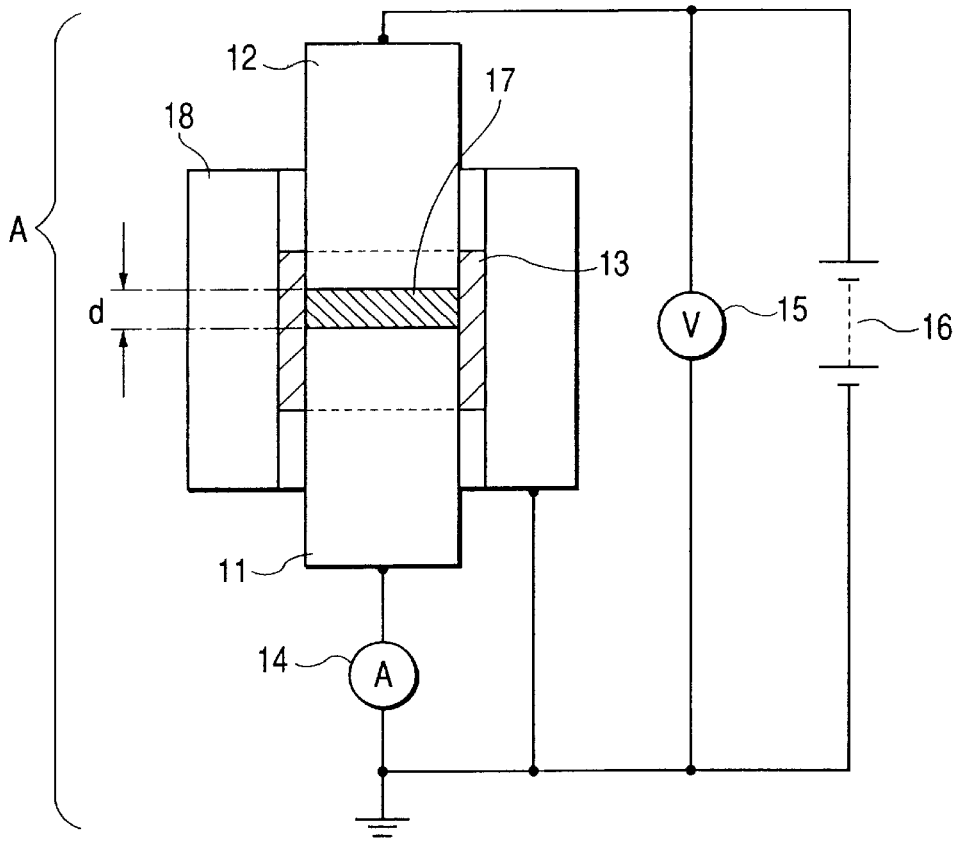
FIG. 1 cross-sectionally illustrates an example of an apparatus for measuring volume resistivity in the present invention.

The magnetic particles for charging of the present invention are rubbed against an image-bearing member on which an electrostatic latent image is to be formed, to charge the image-bearing member electrostatically, and comprise magnetic particles, first surface coat layers containing a first surface coating agent and covering the surfaces of the magnetic particles, and second surface coat layers containing a second surface coating agent and covering the surfaces of the magnetic particles covered with the first surface coat layers. The magnetic particles for charging contain magnetic particles for charging which have a maximum chord length of 5 μm or larger, and the magnetic particles for charging which have a maximum chord length of 5 μm or larger have a minor-axis length/major-axis length standard deviation of 0.08 or more.

Use of the magnetic particles for charging which are constituted in this way has been found to be remarkably effective for the service durability of magnetic particles for charging and the image quality of images formed. The cause of a lowering of service durability of magnetic particles for charging has been the contamination of surfaces of magnetic particles for charging that is caused by foreign matters such as toner or toner components and paper dust which have mixed into the charging member that holds thereon the magnetic particles for charging. This causes an increase in resistivity of the charging member, so that it becomes unable to sufficiently charge the surface of the image-bearing member (photosensitive member). It has further been found that a deficiency in denseness of contact between the magnetic particles for charging and the image-bearing member surface causes local uneven charging, which appears as delicate uneven colors especially in full-color images. Also, under existing circumstances, the image-bearing member can not well be charged in an environment having a low humidity, that is, any sufficient service durability can not well be achieved, and uneven full-color images tend to be formed.

An influence on images that is caused by the above problems is as follows: Take as an example the case of images formed when reversal development is employed. With progress of a running test of taking copies continuously, ghost images occur along rotational cycles of the image-bearing member even though images free of any problem are formed at the initial stage. Charge potential of the image-bearing member at the time such ghost images occur is equal to that at the initial stage. With further progress of the running test, ground fog occurs. Charge potential of the image-bearing member,(photosensitive member) at this stage has become inferior to that at the initial stage, and in such a state that any potential high enough to obtain fog-free images is not obtainable.

The ghost images are caused by a difference in potential between exposed areas and unexposed areas on the image-bearing member. More specifically, they are caused when the charge uniformity at the time the areas where the potential has a low absolute value (i.e., the exposed areas) are charged is inferior to the charge uniformity at the time the areas where the potential has a high absolute value (i.e., the unexposed areas) are charged. Hence, the history of potential on the image-bearing member appears inevitably as the ghost images.

As to the mechanism by which such problems on images occur, the following is considered in regard to the ghost images.

(A) The charge potential differs greatly between exposed areas and unexposed areas of the image-bearing member.

(B) Toner components not completely removable by cleaning remain on the exposed areas of the image-bearing member, and inhibit the readiness of contact between the magnetic particles for charging and the image-bearing member surface, so that the charge potential becomes non-uniform.

When the exposed areas and unexposed areas are charged, any difference in charge potential between the both makes a history at the time of the formation of a previous image remain to cause the ghost images. Such ghost images may occur not only in charging making use of magnetic particles but also in corona charging or roller charging similarly.

In the case of the charging making use of magnetic particles, however, it reflects any slightly uneven potential even when the charge potential of exposed areas is equal to that of unexposed areas, tending to cause the ghost images. This can be said to be a problem peculiar to the charging making use of magnetic particles.

The above problems are seen to be problems peculiar to the charging making use of magnetic particles, because no correlation is found between the image-bearing member potential and the image quality as long as the charge potential of image-bearing members is measured in conventional methods. Also, these are features not required at all for magnetic particles for development carriers.

In addition, in the case of an image-forming apparatus not having any independent cleaning assembly, what is called a cleanerless image-forming apparatus, especially severe conditions are required in order to prevent occurrence of ghost images, especially because the part where transfer residual toner is present coincides with the part where the image-bearing member is exposed. Accordingly, taking the case of the cleanerless image-forming apparatus as an example to explain the operation and effect of the present invention, the use of the magnetic particles for charging of the present invention brings about the following operation and effect:

(1) The readiness of contact between the magnetic particles for charging and the image-bearing member surface is improved, and hence the image-bearing member can sufficiently be charged even in the presence of transfer residual toner components.

(2) The effect of mutually cleaning the surfaces of magnetic particles for charging is obtainable, on account of which any foreign matters are kept from depositing on the surfaces of magnetic particles for charging, and hence the above good readiness of contact may less deteriorate even after long-term service.

As the result, it has become possible to form stable images over along period of time even when components inhibitory to the readiness of contact are present on the photosensitive member in a large quantity in an environment of low humidity. In the magnetic particles for development carriers, toner is present between magnetic particles in a large quantity, and hence any effect of surface cleaning attributable to the mutual contact of magnetic particles can not be expected. Thus, the environment surrounding the magnetic particles and the feature required for them quite differ between the charging and the development.

As described previously, among the magnetic particles constituting the magnetic particles for charging of the present invention, those having a maximum chord length of 5 μm or larger are characterized by having a minor-axis length/major-axis length standard deviation of 0.08 or more. If this standard deviation is too smaller than the lower limit of the above range, the magnetic particles may have too little scattering in shape to bring about no sufficient mutual surface cleaning effect. It is presumed that, because of the presence of particles having shapes suited for cleaning against a load acting between charging particles, the scattering in shape of the magnetic particles makes it possible for, e.g., some magnetic particles having sharp edges to scrape off the contamination of other magnetic particles, to bring about the surface cleaning effect.

Among the above magnetic particles, those having a maximum chord length of from 5 to 20 μm may preferably have a minor-axis length/major-axis length standard deviation of 0.08 or more. This is preferred because the surface cleaning effect can be more improved. Those having this standard deviation in a range of 0.10 or more are more preferred.

The maximum chord length of magnetic particles refers to a maximum value of length between arbitrary two points on the surface of a magnetic particles. Also, the minor-axis length and major-axis length of magnetic particles in the present invention can be, where the form of a two-dimensional image (such as an electron microscope image) of the magnetic particle is replaced with an ellipse, regarded as the length of minor axis and length of major axis of the ellipse.

A method of measuring the minor-axis length/major-axis length standard deviation is exemplified below. Using an electron microscope FE-SEM (S-800), manufactured;by Hitachi Ltd., 100 particles are picked up at random from magnetic-particle images magnified to 500 times. On the basis of their image information, the results of image analysis are statistically processed on Image Analyzer V10 (manufactured by Toyobo Co., Ltd.). As to details of the analysis, image signals having passed through a stereomicroscope are inputted from an electron microscope photograph to the analyzer, where the image information is binary-coded. Next, on the basis of the binary-coded image information, analysis as shown below is made. Its details are specifically set forth in a specification of Image Analyzer V10. To describe the method simply, after the processing to replace the shape of an object to an ellipse, the ratio of the major-axis length to the minor-axis length of the ellipse is found. The processing is carried out in the following way.

Where the specific gravity of a microscopic area $\Delta s=\Delta u\cdot v$ at coordinates (u, v) is regarded as 1 with respect to the binary-coded shape of a magnetic particle, passing the center of gravity of the binary-coded shape of the particle, with respect to the origin (X, Y), the secondary moment in respect of the horizontal axis and that of the vertical axis (the secondary moment in respect of the horizontal axis is represented by Mx, and the secondary moment in respect of the vertical axis by My) are represented by the following equations, respectively.

$$Mx=\Sigma\Sigma(u-X)^2,$$

$$My=\Sigma\Sigma(v-Y)^2.$$

Multiplication moment of inertia, Mxy, is represented by the following equation.

$$Mxy=\Sigma\Sigma(u-X)\cdot(v-Y).$$

The angle θ that satisfies the following equation has two solutions.

$$\theta=\tfrac{1}{2}\cdot\{2\cdot Mxy/(Mx-My)\}.$$

Moment of inertia in the axial direction that is at an angle θ with the horizontal axis, Mθ, is also represented by the following equation.

$$M\theta=Mx\cdot(\cos\theta)^2+My\cdot(\sin\theta)^2-Mxy\cdot\sin 2\theta.$$

The two solutions of the above θ are substituted, and a smaller Mθ of those thus calculated is the principal axis. Also, points corresponding to $(1/M\theta)^{0.5}$ are plotted on an arbitrary axis, where these form an ellipse. Where this principal axis coincides with the principal axis of inertia, the following ellipse is formed when the direction which takes a smaller value of Mθ is represented by A, and that taking a larger value by B.

$$A\cdot x^2+B\cdot y^2=1.$$

The minor-axis length/major-axis referred to in the present invention is one represented by the following equation with respect to the above ellipse. Minor-axis length/major-axis length=$(A/B)^{0.5}$.

The minor-axis length/major-axis length standard deviation of the magnetic particles of the magnetic particles having a maximum chord length of 5 μm or larger and that of the,magnetic particles of the magnetic particles having a maximum chord length of from 5 μm to 20 μm are also analyzed on the magnetic particles of the magnetic particles having a maximum chord length of 5 μm or larger and those of from 5 μm to 20 μm in the above electron microscope photograph.

Average particle diameter and particle size distribution of the above magnetic particles for charging are measured with a laser diffraction type particle size distribution measuring instrument HELOS (manufactured by Nippon Denshi K.K.), where as a measurement range the range of from 0.5 to 350 μm in particle diameter is logarithmically divided into 32, and the 50% by volume median diameter is regarded as the average particle diameter.

The magnetic particles for charging may preferably have an average particle diameter in the range of from 10 to 200 μm, and more preferably in the range of from 15 to 30 μm. If the magnetic particles for charging have too smaller an average particle diameter than the lower limit of the above range, the magnetic particles for charging tend to leak from the charging member, and also, when the magnetic particles for charging are used in the form of a magnetic brush, the magnetic particles for charging thus used may have a poor transport performance. If on the other hand they have too large an average particle diameter than the upper limit of the above range, the uniformity of charging of the image-bearing member tends to deteriorate when the magnetic particles for charging are used in a method of injection charging described later.

As the magnetic particles used in the magnetic particles for charging of the present invention, ferrite particles may preferably be used. As composition of ferrite, those containing any of metallic elements such as copper, zinc, manganese, magnesium, iron, lithium, strontium and barium may preferably be used.

Some prior art discloses use of magnetic particles prepared by kneading magnetite and resin followed by pulverization. Such magnetic particles, however, contains a resin component in a large quantity, and hence tend to leak much from the charging member. Also, in such resin magnetic particles, the resin is present on the particle surfaces in a high percentage, and conducting-path magnetic particles are present in a low percentage. Because of this fact, their resistance tends to increase as a result of surface contamination due to foreign matters and a sufficient effect of improving service durability can be obtained with difficulty.

Meanwhile, to make studies only the magnetic particles having the above preferable shape distribution were used as the magnetic particles for charging in the formation of full-color images. As the result, it was revealed that a change in tints occurs on color images, in particular, yellow images to cause a problem on color reproducibility concerning yellow. According to studies made by the present inventors, it has been found that a lowering of color reproducibility is due to ultrafine dark brown particles of about 0.1 μm in particle diameter which are present on yellow images together with toner. Magnetic particles of about 0.1 μm in particle diameter are formed as ultrafine particles of about 0.1 μm when the shape of magnetic particles are so controlled that the magnetic particles having a maximum chord length of 5 μm or larger may have a minor-axis length/major-axis length standard deviation of 0.08 or more. Such ultrafine particles strongly adhere to the surfaces of magnetic particles having a relatively large particle diameter, by the action of electrostatic force, van der Waals force, or magnetomotive force ascribable to making particles fine, and can not be removed in usual classification steps to remain on particle surfaces and be present in that state. Where magnetic particles are set in a charging member in this state and images are formed, a load applied to the contact portion between the magnetic brush and the image-bearing member causes the ultrafine particles to become liberated from the surfaces of magnetic particles having a relatively large particle diameter, and adhere to the surface of the image-bearing member. In this state, the ultrafine particles reach a developing assembly, and is collected in the developing assembly to become adhered to toner particle surfaces. This toner to which the ultrafine particles stand adhered participates in development, and moves onto images, so that the ultrafine dark brown particles of about 0.1 μm are present in toner having been fixed to the transfer medium and colors look darkish, as having been so ascertained.

As a result of extensive studies, the present inventors have brought forth a method of preventing such a lowering of color reproducibility without causing any deterioration of characteristics required as magnetic particles. More specifically, the magnetic particles for charging of the present invention are characterized by having i) the above magnetic particles, ii) first surface coat layers containing a first surface coating agent and covering the surfaces of the magnetic particles and iii) second surface coat layers containing a second surface coating agent and covering the surfaces of the first surface coat layers.

The formation of first surface coat layers on the magnetic particle surfaces enables the ultrafine particles of about 0.1 μm to be bonded to the relatively large particle diameter magnetic particles at their hollow spots on the surfaces so as not to come off. The further formation of second surface coat layers on the surfaces of the first surface coat layers makes it possible to bond any ultrafine particles which have not well completely been bonded to the magnetic particles through only the first surface coat layers and also to provide constitution of protecting the first surface coat layers to keep colors from being darkish.

Here, the first and second surface coating agents constituting the first and second surface coat layers may preferably be nitrogen-containing materials and/or compounds containing an alkyl chain having 6 or more carbon atoms (hereinafter "C6 or more" in some cases). Use of such surface coating agents enables the ultrafine particles to be prevented from becoming liberated from the magnetic particles, even against the load applied to their portion coming into contact with the photosensitive member (image-bearing member) in the case when the magnetic particles for charging are used in the form of a magnetic brush. Hence, the colors of images can be prevented from being darkish because-of the adhesion of ultrafine particles to toner.

These coat layers may contain a nitrogen-containing material. Especially where the coat layers containing a nitrogen-containing material are present on the surfaces of magnetic particles, a triboelectric chargeability to toner is imparted to the magnetic particles for charging, and hence the polarity of a toner mixed into the charging member can be controlled and the toner can be confined electrostatically. The toner whose polarity has been controlled can be thrown out on the side of the photosensitive member electrostatically by means of a charging bias, and hence the toner is also prevented from accumulating in the interior of the charging member. As the result, the toner can be prevented from scattering and from causing a lowering of charging performance.

Commonly available coating agents used to form the coat layers in the present invention may include, e.g., coupling agents, resins, oils such as silicone oil, resins modified with coupling agents, and materials composed of a mixture of any of these. Of these, the coating agents may preferably be organic compounds containing a metal selected from titanium, aluminum, silicon and zirconium, or the coupling agents. These coating agents react with magnetic particle surfaces, and hence can make the ultrafine particles less come off from the magnetic particles. This enables formation of stable images over a long period of time.

Of the above coating agents, the resins may include silicone resins such as methyl silicone, methylphenyl silicone, silicone acrylic, and silicones modified with silane type coupling agents, polyamide resins such as nylon 6, nylon 12, nylon 46 and aramids, polyurethane resins, melamine resins, fluorine resins such as polytetrafluoroethylene, vinyl chloride resins, polyolefin resins such as PE and PP, epoxy resins, polyester resins such as PET, and polystyrene resins.

As the oils, usable are dimethylsilicone oil, oils terminated with silanol groups, modified silicone oils modified by introducing various organic groups in the side chains or terminals, and methylhydrogensilicone oil hydrogen-introduced in the side chain.

The modified silicone oils may include amino-modified, alcohol-modified, epoxy-modified, carboxyl-modified, methacryl-modified, phenol-modified, mercapto-modified, alkoxyl-modified, polyether-modified, fatty-acid-ester-modified, alkyl-modified, styryl-modified and fluorine-modified silicone oils. They may also include those modified by introducing two types or more of organic groups, e.g., an amino group and an alkoxyl group, or an amino group and an epoxy group.

The coupling agents in the present invention refer to compounds having a hydrolyzable group and a hydrophobic group in the same molecule, bonded to the central element such as silicon, aluminum, titanium or zirconium. Preferred coupling agents may include silane type coupling agents, titanate type coupling agents and aluminum type coupling agents.

As the hydrolyzable group of the above coupling agents, usable are, e.g., alkoxyl groups such as a methoxyl group, an ethoxyl group, a propoxyl group and a butoxyl group, which are relatively highly hydrophilic. Besides, also usable are an acryloxyl group, a methacryloxyl group, modified products of these, and halogens.

As the hydrophobic group, usable are, in the titanate type coupling agents, acylate, phosphate, sulfonate, amino type and alcoholate groups; in the silane type coupling agents, functional groups such as a vinyl group, a methacrylic group, an ether bond, an epoxy group, an amino group and a mercapto group; and in the aluminum type coupling agents, a chelate type group.

The nitrogen-containing material for the coat layers may preferably be a material containing an amino group. The material containing an amino group may include, among the above coating agents, e.g., amino-group-containing coupling agents, amino-modified resins, amino-modified silicone oils modified by introducing amino groups in the side chains or terminals of silicone oil, resins modified with amino-group-containing coupling agents, and materials obtained by mixing any of these amino-group-containing materials with other resins, oils and coupling agents.

In order for the magnetic particles for charging to exhibit uniform chargeability and high service durability, the readiness of contact between that magnetic particles for charging and the photosensitive member is an important factor. In order to impart a preferable readiness of contact to the magnetic particles for charging it is preferable to use materials which can reflect the surface shape of magnetic particles as far as possible also after the formation of the coat layers. Such materials for the coat layers may preferably be coupling agents and oils that enable thin-layer coating. As stated previously, in view of high service durability of the coat layers, coupling agents are more preferred, which enables direct coupling with magnetic particle surfaces.

Such coupling agents may further preferably be amino-group-containing coupling agents the central element of which is an element selected from silicon, titanium, aluminum and zirconium.

As examples of the coupling agents, they may include isopropyltri(N-aminoethyl-aminoethyl)titanate, aminopropyltrimethoxysilane, aminopropyltriethoxysilane, dimethylaminopropyltrimethoxysilane, diethylaminopropyltrimethoxysilane, dipropylaminopropyltrimethoxysilane, dibutylaminopropyltrimethoxysilane, monobutylaminopropyltrimethoxysilane, dioctylaminopropyldimethoxysilane, dibutylaminopropyldimethoxysilane, dibutylaminopropylmonomethoxysilane, dimethylaminophenyltriethoxysilane, trimethoxysilyl-γ-propylphenylamine and trimethoxysilyl-γ-propylbenzylamine. These coupling agents may each be used alone or may be used in the form of a mixture of any desired two or more types.

The alkyl chain may preferably have 6 to 30 carbon atoms, and more preferably 8 to 30 carbon atoms. If the alkyl chain has carbon atoms in too larger a number than the upper limit of the above range, the coating agents tend to be insoluble in solvents to make it difficult to form the first and second surface coat layers uniformly on the magnetic particle surfaces. Also, the magnetic particles for charging may have a very poor fluidity, resulting in a non-uniform charging performance in some cases.

The hydrophobic group may preferably contain a structure wherein 6 or more carbon atoms stand in a straight chain. In their form of bonding to the central element, they may be bonded via carboxylic acid ester, alkoxyl, sulfonic acid ester or phosphoric acid ester, or may directly be bonded. The hydrophobic structure may further contain a functional group such as an ether bond, an epoxy group or an amino group.

Some preferred examples of the compound having a hydrolyzable group and a hydrophobic group containing a structure wherein 6 or more carbon atoms stand in a straight chain, bonded to the central element selected from titanium, aluminum, silicon and zirconium are shown below, which are preferably usable in the present invention.

$(CH_3O)_3—Si—C_{12}H_{25}$ $(CH_3O)_3—Si—C_{18}H_{37}$ $(CH_3O)_3—Si—C_8H_{17}$ $(CH_3O)_2—Si—(C_{12}H_{25})_2$

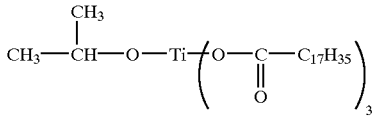

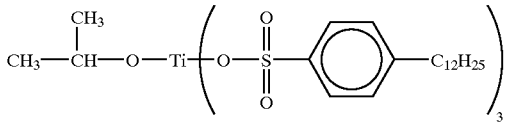

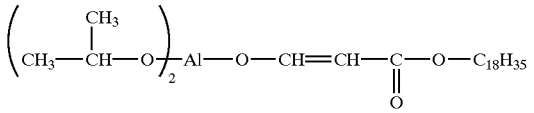

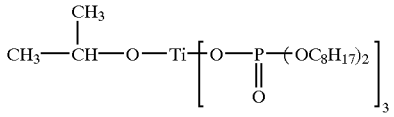

-continued

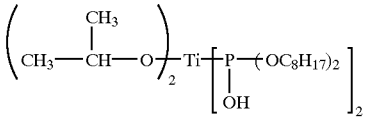

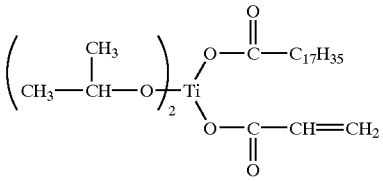

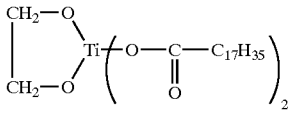

$C_6H_{13}$—$SiCl_3$

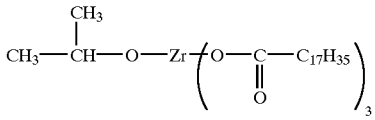

The silane type coupling agents may include, e.g., hexamethyldisilazane, trimethylsilane, trimethylchlorosilane, trimethylethoxysilane, dimethyldichlorosilane, methyltrichlorosilane, allyldimethylchlorosilane, allylphenyldichlorosilane, benzyldimethylchlorosilane, bromomethyldimethylchlorosilane, α-chloroethyltrichlorosilane, β-chloroethyltrichlorosilane, chloromethyldimethylchlorosilane, triorganosilyl mercaptan, trimethylsilyl mercaptan, triorganosilyl acrylate, vinyldimethylacetoxysilane, dimethyldiethoxysilanel, dimethyldimethoxysilane, diphenyldiethoxysilane, hexamethyldisiloxane, 1,3-divinyltetramethyldisiloxane and 1,3-diphenyltetramethyldisiloxane.

The titanate type coupling agents may include, e.g., diisopropyldidodecylbenzenesulfonyl titanate, isopropyltrioctanoyl titanate, isopropyldimethacrylisostearoyl titanate, diisopropyldiisostearoyl titanate, isopropylstearoyldiacryl titanate, and isopropyltricumylphenyl titanate.

The aluminum type coupling agents may include, e.g., acetoalkoxyaluminum diisopropylates.

The first and second surface coat layers may be present in an amount of from 0.01 to 2.0% by weight, and more preferably from 0.05 to 1.0% by weight, in total, based on the weight of the magnetic particles. If the first and second surface coat layers are present in an amount too less than the lower limit of the above range, the ultrafine particles may be bonded to the magnetic particles at an insufficient force. If on the other hand they are in an amount too more than the upper limit of the above range, the magnetic particles for charging may have a high resistivity and also may have a poor fluidity, making it difficult to be usable as magnetic particles for charging.

Here, the amount in which the first and second surface coat layers are present is calculated on the basis of weight loss on heating, and corresponds to percentage loss of mass at 150 to 800° C. in an atmosphere of nitrogen in analysis made using a thermobalance.

In the formation of the first and second surface coat layers, the magnetic particles for charging have a poor fluidity in some cases if coating treatment is so made in one time that the layers may be present in an amount of from 1.0 to 2.0% by weight. The fluidity is seen to be improved when the coating treatment is stepwise divided in a plurality of times.

In the present invention, in the case when the first and second surface coat layers are formed using the coupling agents described above, the respective surface coat layers may preferably be formed using only the coupling agents, but a resin component may also be coated in a trace quantity. In such a case, the resin component may preferably substantially be equal to or less than the amount of the coupling agents.

The first surface coating agent constituting the first surface coat layers and the second surface coating agent constituting the second surface coat layers may be the same or different in the compounds described above.

The scatter of toner from the charging member is known to relate to increase in transfer residual toner, high-humidity condition, high-speed rotation of the charging member and so forth.

For example, continuous formation of images having a high image area percentage brings about an increase in transfer residual toner, and also an increase in the toner mixing into the charging member. Even in such a case, the magnetic particles for charging of the present invention have a good lubricity, triboelectricity-providing performance and releasability, and hence can prevent the toner from accumulating in the charging member and the magnetic particles for charging from undergoing surface contamination, and can prevent the toner from scattering and the charging member from undergoing resistance variation.

Under conditions of high humidity, the chargeability of toner may lower under influence of moisture content in the air, resulting in a state where the scatter of toner from the charging member tends to occur. The magnetic particles for charging of the present invention has a high readiness of contact with the toner, and hence can exhibit an advantageous effect on triboelectricity to toner to prevent the toner scatter. In addition, when the coating agents having a C6 or more alkyl chain are used, the magnetic particle surfaces are made hydrophobic, and hence the toner can sufficiently be charged while eliminating the influence of moisture content even under long-term high-humidity conditions.

The magnetic particles for charging of the present invention can effectively act to prevent accumulation of and contamination by toner even in, e.g., machines having a high process speed such that the charging member charges the photosensitive member while rubbing the latter's surface at a high speed. In recent years, image-forming apparatus of a cleaning-at-development (cleanerless) system have been commerciallized, which have no independent cleaning assembly for removing and collecting the transfer residual toner on the photosensitive member and clean the photosensitive member at the part of a developing assembly. In such image-forming apparatus, the transfer residual toner is always present at the charging nip, and hence it has been considered severer to prevent the toner scatter, charging member resistance variation, occurrence of ghost images and so forth. Accordingly, the magnetic particles for charging of the present invention may be used, where the transfer residual toner can effectively be taken in and thrown out, and hence the toner is not accumulated on the charging member and at the same time the toner scatter can be prevented by virtue of good charge-providing properties for the toner. Also, the magnetic particles for charging of the present invention have a good surface releasability and have the effect of mutually cleaning particle surfaces between magnetic particles, so that the toner can be kept from being contaminated even in its long-term service.

The surface structure of the magnetic particles for charging produced by the production process of the present invention can be ascertained in the following way.

Specifically, the layer configuration in the vicinity of the surfaces of the magnetic particles for charging can be observed with a cross-section transmission type microscope. In the case when the first an second surface coating agents contain elements different from each other, characteristic X-rays generated in the vicinity of the surfaces of the magnetic particles for charging may be observed, whereby the state of distribution of elements is observed in layers. Also, the magnetic particles for charging of the present invention may successively be dissolved from the surface, using a high-solvency solvent such as chloroform, and the resultant solution may be analyzed by infrared absorption spectroscopy or H- or $^{13}$C-NMR to ascertain that components constituting the surface layers have a gradation. Still also, TOF-SIMS (time-of-flight secondary-ion mass spectroscopy) and ESCA (electron spectroscopy for chemical analysis) surface analysis means may be used.

For example, in IR (infrared absorption spectroscopy), the nitrogen-containing material has peaks due to $NH_2$ and NH which appear at 3,360 $cm^{-1}$ and 1,590 $cm^{-1}$ and 1,590, and a peak presumed to be due to tertiary amide, at 1,631 $cm^{-1}$. In the case of an aminosilane treating agent, a peak due to Si—O—Si appears at 1,120 $cm^{-1}$ in addition to the peaks due to nitrogen. Also, in the case of a titanium type coupling agent of an acylate type (e.g., isopropoxytitanium tristearate), the presence of carboxylic acid and carboxylates is recognizable from peaks at 1,110 to 1,249 $cm^{-1}$ and 1,735 $cm^{-1}$ and from the copresence of these peaks and a peak in the vicinity of 1,710 $cm^{-1}$.

In the ESCA (electron spectroscopy for chemical analysis), N of the nitrogen-containing material and Ti or Si which is the central element of the coupling agent are readily detectable from spectra. From the state of spectra (chemical shifts) it is also assignable that N, Si and Ti are an amine, an organosilicon compound and an organotitanium compound, respectively. The amount in which each component is present can relatively be known from peak intensity ratios, and the absolute quantity is also estimable from a calibration curve based on a known material.

In the case when the above titanium type coupling agent isopropoxytitanium tristearate (TTS) is used as the material containing an alkyl chain having 6 or more carbon atoms, in H-NMR it is assignable to an isopropoxy compound and a long-chain alkylcarboxylic acid compound from peaks at 5.13, 2.46, 1.88, 1.48 and 0.98 ppm.

In the TOF-SIMS (time-of-flight secondary-ion mass spectroscopy), the outermost surface (several atom layers) of the coat layers can be analyzed, and N of the nitrogen-containing material and Ti or Si which is the central element of the coupling agent are detectable as elementary ions. Rational formulas can further be specified from the detection of fragment ionic species. For example, it has been ascertained that peaks of m/z=147, 175 and 191 indicate aminosilane. Also, even in the same coating material, peak intensities of elementary ions or fragments change depending on treatment temperature. In the case when aminosilane is used as the nitrogen-containing material, the peak intensity of $NH_4$ (m/z=18) decreases by about 35% from 290 as a result of the raising of treatment temperature from 120° C. to 170° C. Treatment conditions can be ascertained from the rate of such changes.

In the above chemical analyses, the analysis can be made even when the materials constituting the coat layers are present in plurality, where the gradation of concentration of coat components can be examined by devising how the coat components are extracted with a solvent. This makes it possible to distinguish a case where a plurality of materials are simultaneously mixedly coated to form a coat layer (hereinafter "simultaneous coating" in some cases) from a case where they are separately coated, i.e., a second coat layer is formed on a first coat layer (hereinafter "two-stage coating" in some cases). For example, when aminosilane, which is soluble in ethanol, and TTS, which is insoluble in ethanol, are used as coating materials and an aminosilane second coat layer is formed on a TTS first coat layer, the aminosilane dissolves selectively by ethanol extraction. When, however, these are mixed and simultaneously coated, the contact of ethanol with the aminosilane is inhibited by the TTS, resulting in a low extraction quantity.

Where Soxhlet extraction with toluene, in which the both are soluble, and H-NMR analysis are made, a spectrum assigned to the isopropoxy compound not detectable in the case of the two-stage coating is obtainable in the case of the simultaneous coating.

In the TOF-SIMS, ESCA and cross-section transmission type microscopy, which can analyze the outermost layer, it is detectable that the intensity of presence of the first coat layer (TTS) in the case of the two-stage coating has a tendency of being lower than that in the simultaneous coating, and hence the simultaneous coating is distinguishable from the two-stage coating on the basis of the relationship between the absolute quantity (estimable from the above chemical analysis) of the coat materials and the intensity of its presence. Also, coating means are distinguishable also on the basis of the fact that the $NH_4$ ions detected by TOF-SIMS have a stronger intensity in the two-stage coating than in the simultaneous coating.

The components of coat layers and the coating means can be proved by the above methods.

The magnetic particles for charging of the present invention may preferably have a volume resistivity of from $10^4$ to $10^9$ Ω·cm. If they have a volume resistivity too lower than the lower limit of the above range, they tend to cause pinhole leak. If on the other hand they have a volume resistivity too higher than the upper limit of the above range, the photosensitive member tends to be insufficiently charged. Also, from the viewpoint of preventing leakage of magnetic particles, the magnetic particles for charging may more preferably have a volume resistivity of from $10^6$ to $10^9$ Ω·cm.

An example of an instrument for measuring the volume resistivity of magnetic particles is cross-sectionally shown in FIG. 1. First, a cell A is packed with magnetic particles for charging, 17, to be measured. Along a guide ring 13, electrodes 11 and 12 whose surroundings are insulated with insulators 18 are so provided as to come into contact with the magnetic particles for charging, 17. A voltage is applied across these electrodes 11 and 12 and the current flowing there is measured with an ammeter 14. Voltage is monitored on a voltmeter 15 and regulated by voltage stabilizer 16. Volume resistivity is calculated from the voltage and current detected. The measurement is made under conditions of;

contact area between the magnetic particles for charging held in the cell and the electrodes: 2 $cm^2$;

thickness d of magnetic particles for charging: 1 mm;

load applied to the upper electrode: 10 kg; and applied voltage: 100 V;

in environment of temperature 23° C. and humidity 65%.

A preferred production process for the magnetic particles for charging of the present invention will be described below.

The production process of the present invention which is used to produce the above magnetic particles for charging is characterized by having the steps of preparing magnetic particles by pulverization; coating the pulverized magnetic particles with a first surface coating agent to form first surface coat layers on their surfaces; and coating the magnetic particles on which the first surface coat layers have been formed, with a second surface coating agent to form second surface coat layers on the former's surfaces.

Figure 6A:
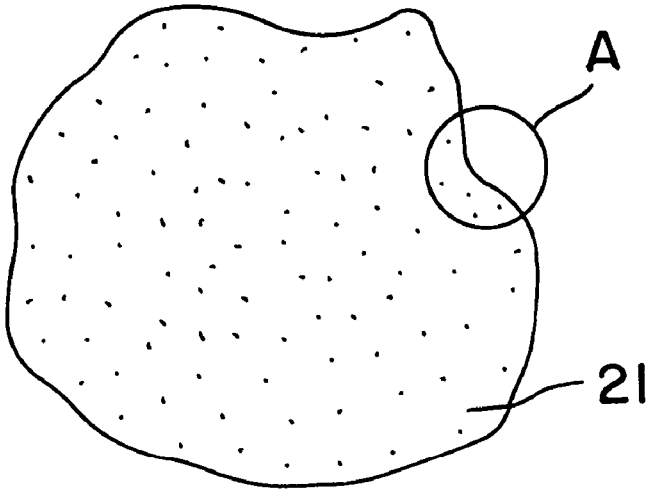
FIG. 6A schematically illustrates a magnetic particle of the invention.
Figure 6B:
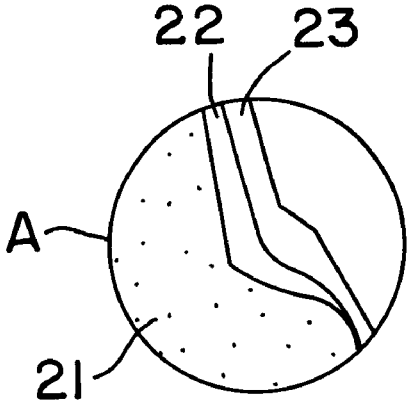
FIG. 6B schematically illustrates an exploded view of a portion of the magnetic particle of FIG. 6A illustrating coated layers thereon.

FIG. 6A schematically shows magnetic particle 21 formed by the production process. In FIG. 6B a portion "A" of magnetic particle 21 is illustrated in an exploded view illustrating the presence of first surface coat layer 22 and second surface coat layer 23.

In the case when ferrite is used in the magnetic particles, a preferred production process for ferrite particles may include a process in which ferrite particles having an average particle diameter of from 20 to 200 $\mu$m are further pulverized. Also, after they are pulverized while controlling shape distribution, classification may appropriately be carried out. A process of producing them by pulverizing a ferrite mass is also possible, but, from the viewpoint of production efficiency, it is preferred to further pulverize the ferrite particles.

In the step of forming the first surface coat layers, the magnetic particles and the first surface coating agent are mixed and agitated to effect surface coating. Here, by the action of agitation shear, the ultrafine particles present on the magnetic particle surfaces are swept up in the latter's hollow spots and are set immovable there with the first surface coating agent. However, ultrafine particles not sufficiently be set immovable with only this first surface coating agent may remain.

In the step of forming the second surface coat layers, the same treatment as that in the step of forming the first surface coat layers is made. This makes the remaining ultrafine particles be further set immovable and also protects the first surface coat layers. Thus, the magnetic particles for charging of the present invention can be obtained.

As methods of forming the respective surface coat layers, either of dry-process coating and wet-process coating is usable. From the viewpoint of the uniformity of surface treatment, wet-process coating may preferably be used. As examples of a specific apparatus used in the production, it may include stationary agitators having i) a tank having a heating means and ii) an agitation means, such as Henschel mixer and Nauta mixer, and fluidized-bed dryers. In addition, it is preferable in the present invention to use stationary agitators that can apply a shear force preferable for the effective bonding of ultrafine particles.

Incidentally, in the present specification, the double-layer surface coat layers formed on the magnetic particle surfaces are described as the first surface coat layers and the second surface coat layers. What is meant by "the first" and "the second" is the order of the double-layer surface coat layers, and shows that the first surface coat layers are formed and thereafter the second surface coat layers are formed thereon, without excluding any additional coating before the first coating or between the first coating and the second coating and third and subsequent coating.

The compounds having a lubricity and having a C6 or more alkyl group may be used as the first and second surface coating agents, whereby the magnetic particle surfaces can be less affected by the agitation shear at the time of surface treatment and the ultrafine particles set immovable to the magnetic particle surfaces can be made to less come off during the agitation. For this reason, it is preferable to use coating agents having an alkyl group having 6 or more carbon atoms, which have a lubricity. It is especially remarkably effective where the above compound is used as the first surface coating agent. Also when the compound is used as the second surface coating agent, the effect of lubricity is obtainable, and hence magnetic particles for charging contributory to the formation of sharp full-color images can be produced.

For the purpose of further uniform surface coating, the surface coating agents may each be dispersed or dissolved in a solvent, followed by removal of the solvent to obtain the magnetic particles for charging. Especially when the second surface coating agent is coated, it is preferable for the second surface coating agent to be coated after it has been dispersed or dissolved in a solvent in which the first surface coating agent is insoluble. This is because, if a solvent in which the first surface coating agent is soluble is used when the second surface coating agent is coated, this solvent may attack the first surface coating agent having already set the ultrafine particles immovable and more ultrafine particles may come off.

The first surface coat layers may also preferably be cured at a temperature higher than the temperature at which the second surface coat layers are cured. Where the first surface coat layers are cured at a temperature higher than the curing temperature for the second surface coat layers, the second surface coat layers are formed at a temperature lower than the first surface coat layers. Hence, the first surface coat layers can be prevented from being thermally denatured when the second surface coat layers are formed. Also, components of the first surface coat layers can be prevented from acting non-uniformly on the second surface coat layers. As the result, the first surface coat layers and the second surface coat layers can be produced in a good reproducibility, and hence the effect of the present invention can well be exhibited.

The image-forming apparatus employing the magnetic particles for charging of the present invention will be described below.

The image-forming apparatus of the present invention is characterized by having an image-bearing member on which an electrostatic latent image is to be formed; a charging means for charging the image-bearing member electrostatically by bringing a charging member into contact with the image-bearing member; the charging member comprising a magnet member having a conductor to which a voltage is to be applied, and the magnetic particles for charging of the present invention which are held on the magnet member by the action of magnetism; an exposure means for exposing to light the surface of the image-bearing member charged by the charging means, to form an electrostatic latent image; a developing means for rendering the electrostatic latent image formed visible by the use of a toner; and a transfer means for transferring a toner image formed by rendering the electrostatic latent image visible.

Figure 2:
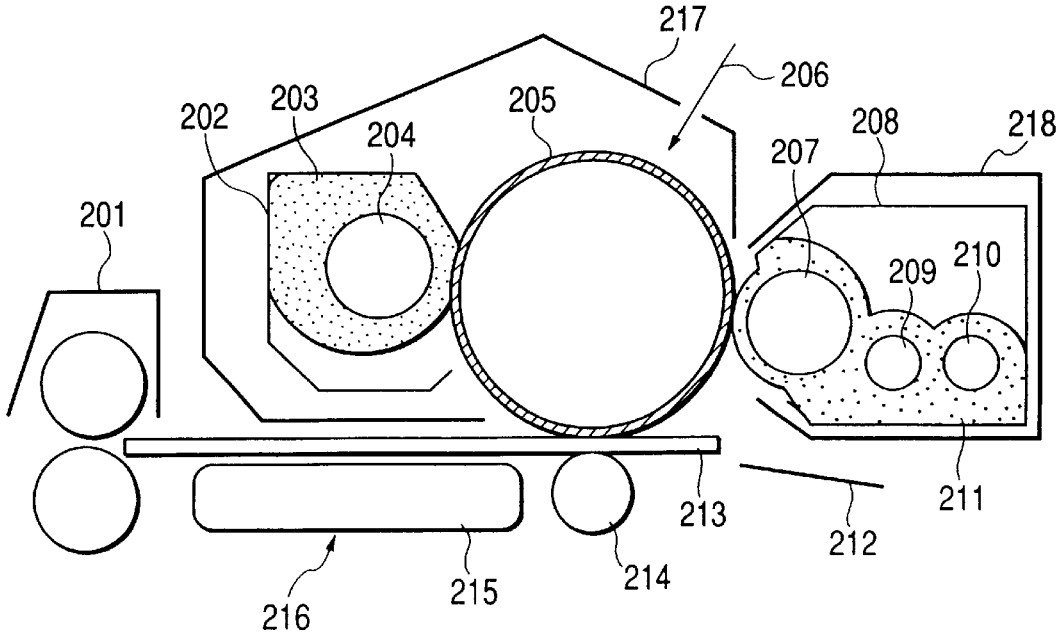
FIG. 2 schematically illustrates the construction of an image-forming apparatus of the present invention.

FIG. 2 schematically illustrates an example of the image-forming apparatus of the present invention. The image-forming apparatus shown in FIG. 2 comprises an image-bearing member 205, a magnetic brush charging means 202 disposed in contact with the image-bearing member 205 and capable of charging the image-bearing member 205 electrostatically by applying a voltage, an exposure means 206 for forming an electrostatic latent image on the image-bearing member 205, a developing means 208 disposed in contact with or proximity to the image-bearing member 205 and capable of developing the electrostatic latent image to form a toner image and also collecting a transfer residual toner remaining on the image-bearing member 205, a transfer means 214 for transferring the toner image to a transfer medium 213, and a fixing means 201 for fixing to the transfer medium 213 the toner image transferred to the transfer medium 213.

The charging means 202 has a conductive sleeve 204 (corresponding to the magnet member) provided internally with a magnet as a holding member, and magnetic particles for charging, 203, of the present invention as the charging member carried on the conductive sleeve 204 by the action of magnetism.

In the charging means 202 in the image-forming apparatus of the present invention, injection charging may preferably be used. When the injection charging is used, the image-bearing member 205 may preferably be so constituted as to have a cylindrical conductive substrate, a photosensitive layer which covers the surface of the substrate, and a charge injection layer formed on the surface of the photosensitive layer. Such constitution enables achievement of a charge potential of 80% or more, and further 90% or more, with respect to the applied voltage. Hence, a more ozoneless charging method can be materialized for the charging method interpreted by the Paschen's low. In this case, when the image-bearing member 205 has this charge injection layer at a position farthest from the conductive substrate, the potential of 90% or more of the applied voltage can be formed on the image-bearing member by DC charging.

Figure 7:
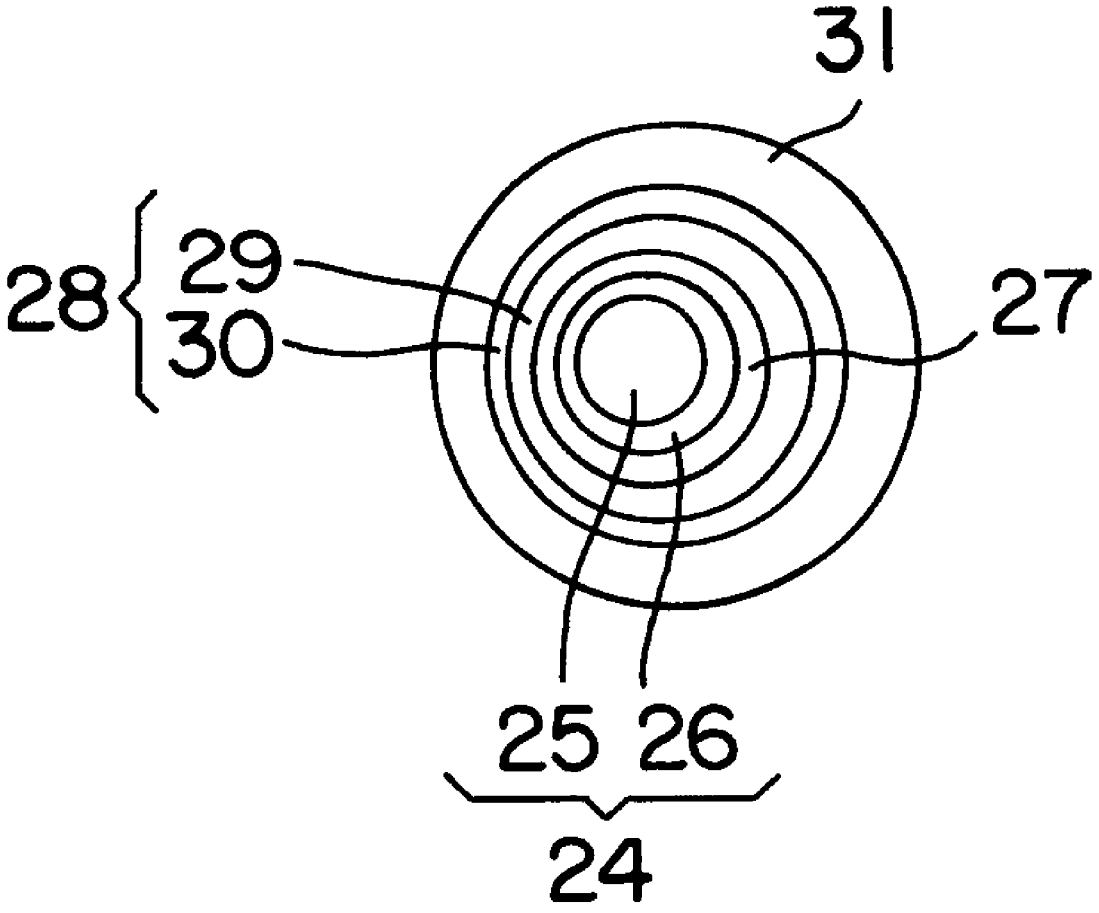
FIG. 7 schematically illustrates a cross-sectional view of an image-bearing member for use in an image-forming apparatus of the present invention.

In FIG. 7, an image-bearing member is shown which is suitable for injection charging. A cylindrical conductive substrate 24 is formed of an aluminum cylinder 25 and a conductive layer 26. A charge injection blocking layer 27 is formed between conductive layer 26 and photosensitive layer 28. Photosensitive layer 28 includes a charge generating layer 29 and a charge transport layer 30. A charge injection layer 31 is the surface layer.

In order for this charge injection layer to have a sufficient charging performance and also fulfill conditions for causing no smeared images, it may preferably have a volume resistivity in the range of from $1\times10^{8}$ to $1\times10^{15}$ Ω·cm. From the viewpoint of preventing smeared images, this layer may preferably have a volume resistivity of from $1\times10^{10}$ to $1\times10^{15}$ Ω·cm, and, taking account of environmental variations also, more preferably from $1\times10^{12}$ to $1\times10^{15}$ Ω·cm. If the charge injection layer has a volume resistivity too smaller than the lower limit of the above range, the photosensitive member can not bear or hold the electrostatic latent image, and may cause smeared images especially in a high-temperature/high-humidity environment. If on the other hand it has a volume resistivity too higher than the upper limit of the above range, the image-bearing member 205 can not sufficiently receive electric charges from the charging means 202 to tend to cause faulty charging.

In the charging means and image-forming apparatus of the present invention, it is also preferable to apply oscillating voltage as the voltage applied to the charging means 202. The application of oscillating voltage enables performance of stable charging against any external disorder of, e.g., mechanical precision. In the injection charging, the application of oscillating voltage brings about an advantage as stated above, but on the other hand involves a limitation on the oscillating voltage to be applied, where it may preferably be applied at a frequency of about 100 Hz to about 10 kHz and a peak-to-peak voltage of 1,000 V or below. This is because, in the injection charging, the potential of the image-bearing member 205 follows with respect to the applied voltage, and hence the potential of the image-bearing member 205 may wave if the peak-to-peak voltage is too high, to cause fog or reversal fog. The oscillating voltage may also be effective when applied at a peak-to-peak voltage of 100 V or above, and preferably 300 V or above. As its waveform, a sine wave, a rectangular wave and a sawtooth wave may be used.

The charge injection layer formed on the uppermost layer of the image-bearing member 205 may be constituted of a material made to have medium resistance by dispersing in an insulating binder resin, light-transmitting and conductive particles in an appropriate quantity. It is also effective to form an inorganic layer having the above resistance. Such a functional surface layer provided as the charge injection layer has the function to retain electric charges injected by the charging means 202, and further has the function to let the electric charges escape to the conductive substrate at the time of exposure to reduce residual potential.

Here, the volume resistivity of the charge injection layer is measured in the following way. A charge injection layer is formed on polyethylene terephthalate (PET) film on the surface of which a conductive film has been formed by vacuum deposition. This is set in a volume resistivity measuring instrument (4140B pAMATER, manufactured by Hewlett Packard Co.) and a voltage of 100 V is applied in an environment of temperature 23° C. and humidity 65% to make measurement.

The conductive particles to be dispersed in the binder resin may have a particle diameter of 0.3 μm or smaller from the view point of light transmission properties, and most preferably 0.1 μm or smaller. They may also preferably be dispersed in an amount of from 2 to 250 parts by weight, and more preferably from 2 to 190 parts by weight, based on 100 parts by weight of the binder resin. If the conductive particles are dispersed in an amount too smaller than the lower limit of the above range, preferable volume resistivity may be achieved with difficulty. If on the other hand they are dispersed in an amount too larger than the upper limit of the above range, the charge injection layer may have a low film strength to tend to be abraded. The magnetic particles for charging may preferably have a layer thickness of from 0.1 to 10 μm, and most preferably from 1 to 7 μm.

The charge injection layer may also preferably be incorporated with a lubricant powder. As expected effects, it can be cited that the friction between the image-bearing member 205 and the charging means 202 is reduced at the time of charging and the nip that participates in the charging is broadened to bring about an improvement in charge characteristics. Also, the surface of the image-bearing member 205 can be improved in releasability, and hence the magnetic particles for charging may less adhere thereto. As the lubricant powder, fluorine resin, silicone resin or polyolefin resin may preferably be used, especially as having a low critical surface tension. What is particularly preferred is polytetrafluoroethylene resin. In this case, the lubricant powder may preferably be added in an amount of from 2 to 50 parts by weight, and more preferably from 5 to 40 parts by weight, based on 100 parts by weight of the binder resin. If the lubricant powder is added in an amount less than the lower limit of the above range, the lubricant powder is in so insufficient a quantity that the charging performance for the image-bearing member 205 can not well effectively be improved, and, from the viewpoint of cleanerless apparatus, the transfer residual toner tends to increase. If it is added in an amount too more than the upper limit of the above range, image resolving power and photosensitive layer sensitivity tend to lower.

In the case when the surface layer is covered with the inorganic layer as the charge injection layer, its underlying layer photosensitive layer may preferably be formed of amorphous silicon, where a blocking layer, the photosensitive layer and the charge injection layer may preferably successively be formed on the conductive substrate by glow discharging or the like.

As materials for the photosensitive layer, conventionally known materials may be used. For example, as organic materials, they may include phthalocyanine pigments and azo pigments. An intermediate layer may also be provided between a surface protective layer (such as the charge injection layer) and the photosensitive layer. Such an intermediate layer aims for an improvement in adhesion between the protective layer and the photosensitive layer or its function as an electric-charge barrier layer. As the intermediate layer, usable are, e.g., commercially available resin materials such as epoxy resins, polyester resins, polyamide resins, polystyrene resins, acrylic resins and silicone resins.

As materials for the conductive substrate of the image-bearing member 205, usable are aluminum, nickel and stainless steel, as well as plastic or glass having a metallic or conductive film, and paper made conductive.

In the image-forming apparatus of the present invention, the voltage applied to the image-bearing member may be a DC voltage on which the oscillating voltage has been superimposed. In such a case, an oscillatory sound caused by oscillatory electric fields can be reduced. This is considered due to the fact that the scattering in shape of the magnetic particles for charging absorbs the oscillation. Also, this can be more greatly effective when the conductive substrate of the image-bearing member has a thickness of from 0.5 to 3.0 mm. If this conductive substrate has a thickness too smaller than the lower limit of the above range, it may have a poor dimensional stability. If on the other hand its has a thickness too larger than the upper limit of the above range, cost disadvantages as exemplified by an increase in torque and a higher material cost may result undesirably.

There is a preferable range also in respect of triboelectric chargeability between the toner used and the magnetic particles for charging, 203, of the charging means 202. Where the toner used is in a proportion of 7 based on 100 of the magnetic particles for charging, the toner's triboelectric value measured, which is in the same sign as the charge polarity of the image-bearing member 205, may be in an absolute value of from 1 to 90 mC/kg, preferably from 5 to 80 mC/kg, and more preferably from 10 to 40 mC/kg. As long as the absolute value of the triboelectric value is within the above range, the toner can well be taken in and thrown out and the image-bearing member 205 can be charged in a good performance.

As a preferable method for measuring the above value is as follows: First, in an environment of temperature of 23° C. and relative humidity of 60%, a mixture prepared by adding 200 mg of toner to 40 g of measurement target magnetic particles for charging is put in a polyethylene bottle of 50 to 100 ml in volume, and this is manually shaken 150 times. The mixture of the toner and the magnetic particles for charging is loaded in the charging means 202 as the magnetic particles for charging. Next, a metal drum having the same dimensions as the image-bearing member 205 to be used is set in the image-forming apparatus, and a DC bias having the same polarity as the charge polarity of the toner is applied to the charging zone, where the metal drum is driven under conditions set when the image-bearing member is charged. Charge quantity of the toner moved here from the charging means 202 onto the metal drum is measured.

In the image-forming apparatus of the present invention, in the case when the magnetic brush is used as the charging member coming into contact with the image-bearing member 205, it may be constituted of a magnet roll or a conductive sleeve having a magnet roll internally, serving as a member (magnet member) for holding the magnetic particles for charging, on the surface of which the magnetic particles for charging have uniformly been coated. Such a member may be used, in particular, a conductive sleeve having a magnet roll and on the surface of which the magnetic particles for charging have uniformly been coated may preferably be used.

The holding member of magnetic particles for charging (a conductive sleeve 204 which is a conductor the magnet member has) and the image-bearing member 205 may be set at a proximate gap of from 0.3 to 2.0 mm. If this gap is too smaller than the lower limit of this range, a leak may occur between the conductive portion of the member of holding magnetic particles for charging and the image-bearing member 205 depending on applied voltages, to damage this image-bearing member 205.

The charging magnetic brush may be provided in either of forward and backward movement directions with respect to the movement direction of the image-bearing member 205 at the contact portion between them. From the viewpoint of the manner in which the transfer residual toner is taken in, it may preferably move in the backward direction.

The magnetic particles for charging, 203, held on the holding member 204 of magnetic particles for charging may preferably be in an amount of from 50 to 500 mg/cm$^2$, and more preferably from 100 to 300 mg/cm$^2$, where a stable charging performance can be attained.

As shown in FIG. 2, the magnetic particles for charging, 203, may be held in excess in the charging means 202 so as to be circulated.

As the imagewise exposure means, known means such as a laser or an LED may be used.

In the image-forming apparatus of the present invention, a step preferable in the cleanerless image-forming method may also be added. In the image-forming apparatus of the present invention, a potential control member for controlling the potential of the image-bearing member may be provided after the step of transfer and before the step of charging. This brings about a more improvement in stability as an image-forming apparatus.

As the potential control member, usable are a member for controlling the surface potential of the photosensitive member (image-bearing member) by emitting light, and a conductive roller, blade or fur brush provided in contact with or proximity to the photosensitive member. In particular, the roller or fur brush may preferably be used. Also, when the potential of the image-bearing member is controlled by applying a voltage to such a potential control member, the potential control member may preferably be controlled to have a polarity reverse to that in the step of charging the image-bearing member. This is because the potential of this image-bearing member should be uniformed to a lower potential before the step of charging the image-bearing member so that the history of images previously formed is erased to facilitate charging uniformity.

The developing means 208 does not require any particular choice. In the case of the image-forming apparatus having no cleaning means (the cleanerless image-forming apparatus), reversal development is preferred. Also, as shown in FIG. 2, the developing means may preferably be so constructed that a developer 211 comes into contact with the image-beating member 205. For example, contact two-component development and contact one-component development are preferred developing methods. This is because, where the developer 211 and transfer residual toner come into contact with the image-bearing member 205, an electrostatic rubbing force is applied and the transfer residual toner can effectively be collected in the developing means 208. As to a bias applied to the developing means 208, its DC component may preferably stand between the potential of black character areas (imagewise exposed areas) and that of white background areas. Reference numeral 207 denotes a developer-carrying member; and 209 and 210, agitating screws.

The transfer means 216 may also employ any known means such as corona, a roller or a belt. In FIG. 2, a transfer means 216 making use of a transfer roller 214 is shown. Reference numeral 212 denotes a paper delivery guide; and 215, a paper delivery belt.

When the transfer residual toner is further transported from the charging means 202 in which it has been collected, to the developing means 208 via the surface of the image bearing member 205 so as to be collected and reused, it can be done even without changing the charging bias of the image-bearing member 205. In practical use, however, any excess toner may mix into a charging assembly when, e.g., the system is jammed with transfer paper or images with a high image area percentage are continuously formed. In such a case, during the operation of image formation, the timer for which any image is not formed on the image-bearing member 205 may be utilized to move the toner from the charging assembly to the developing assembly. Such non-image-forming time is, e.g., forward rotation time, backward rotation time and transfer paper feed intervals. In such a case, it is also preferable to change the charging bias to the one that may make the toner readily movable from the charging means 202 to the image-bearing member 205. As the bias that may make the toner readily movable from the charging means 202, the peak-to-peak voltage of the AC component may be set a little lower or a DC component may be used. Alternatively, a method may be used in which the peak-to-peak voltage is set equal and the waveform is changed to lower the AC effective value.

In addition, in the present invention, taking account of the service life of the charging means 202 and the use of a non-magnetic sleeve 204 internally provided with a magnet, the apparatus may preferably be so constructed that the toner can further be added, because of a demand in respect of cost. In such a case, as the magnetic particles for charging, too, the apparatus may preferably be so constructed that they are made to be present at the charging zone in a quantity larger than,the necessary minimum quantity so that their service durability can be elongated when used circulatively.

As a means for such circulation, it is preferable to agitate magnetic particles mechanically, or to set up magnetic poles that may enable circulation of magnetic particles, or to provide a member that may make magnetic particles movable. For example, the means may be so constructed that an agitating screw member or a repulsive pole is provided on the back of the magnetic brush so that magnetic particles can be again coated while taking them off, or may be provided with a baffle member that may obstruct the flow of magnetic particles.

In the present invention, the image-bearing member, the charging means, and also optionally the developing means and the cleaning means may be supported as one unit to set up a process cartridge (217 in FIG. 2) that is detachably mountable to the main body of the image-forming apparatus. Also, the developing means may be set as a cartridge (218 in FIG. 2) that is separate from the cartridge having the image-bearing member.

As examples of full-color image-forming apparatus in which the magnetic particles for charging are preferably usable, the following embodiments may be given.

Figure 3:
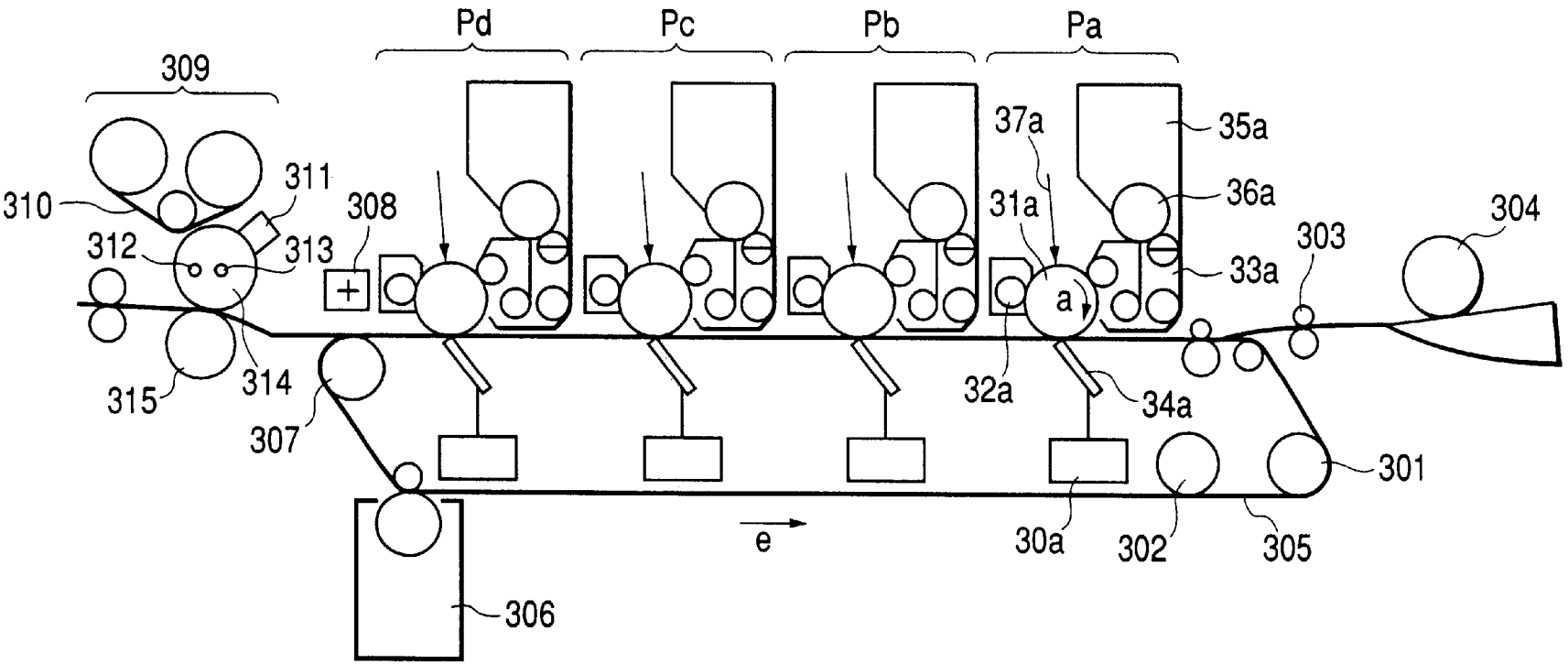
FIG. 3 schematically illustrates a full-color image-forming apparatus that can preferably make use of the magnetic particles for charging of the present invention.

What may be given first is an apparatus having a plurality of units in each of which one image-bearing member has one developing means. FIG. 3 shows its example. In FIG. 3, units each consisting of a transfer bias applying means 30*a*, an image-bearing member (photosensitive member) 31*a*, a charging means (primary charging assembly) making use of the magnetic particles for charging of the present invention, a developing means 33*a*, a transfer blade 34*a*, a toner hopper 35*a*, a replenishing roller 36*a* and an exposure means 37*a* are arranged toner to toner having respective colors. In FIG. 3, reference symbols Pa, Pb, Pc and Pd denote units for forming images by the use of yellow, magenta, cyan and black color toners, respectively. Also, reference numeral 301 denotes a belt follower roller; 302, a belt-charge eliminator; 303, a resist roller; 304, a paper feed roller; 305, a transfer medium carrying transport member; 306, a transfer belt cleaning means; 307, a drive roller; 308, a paper separation charging assembly; 309, a fixing assembly; 310, a web; 311, a temperature detecting means; 312 and 313, heating means; 314, a fixing roller; and 315, a pressure roller; which are those commonly used in conventional image-forming apparatus. Incidentally, in FIG. 3, letter symbols a and e denote rotational directions.

Figure 4:
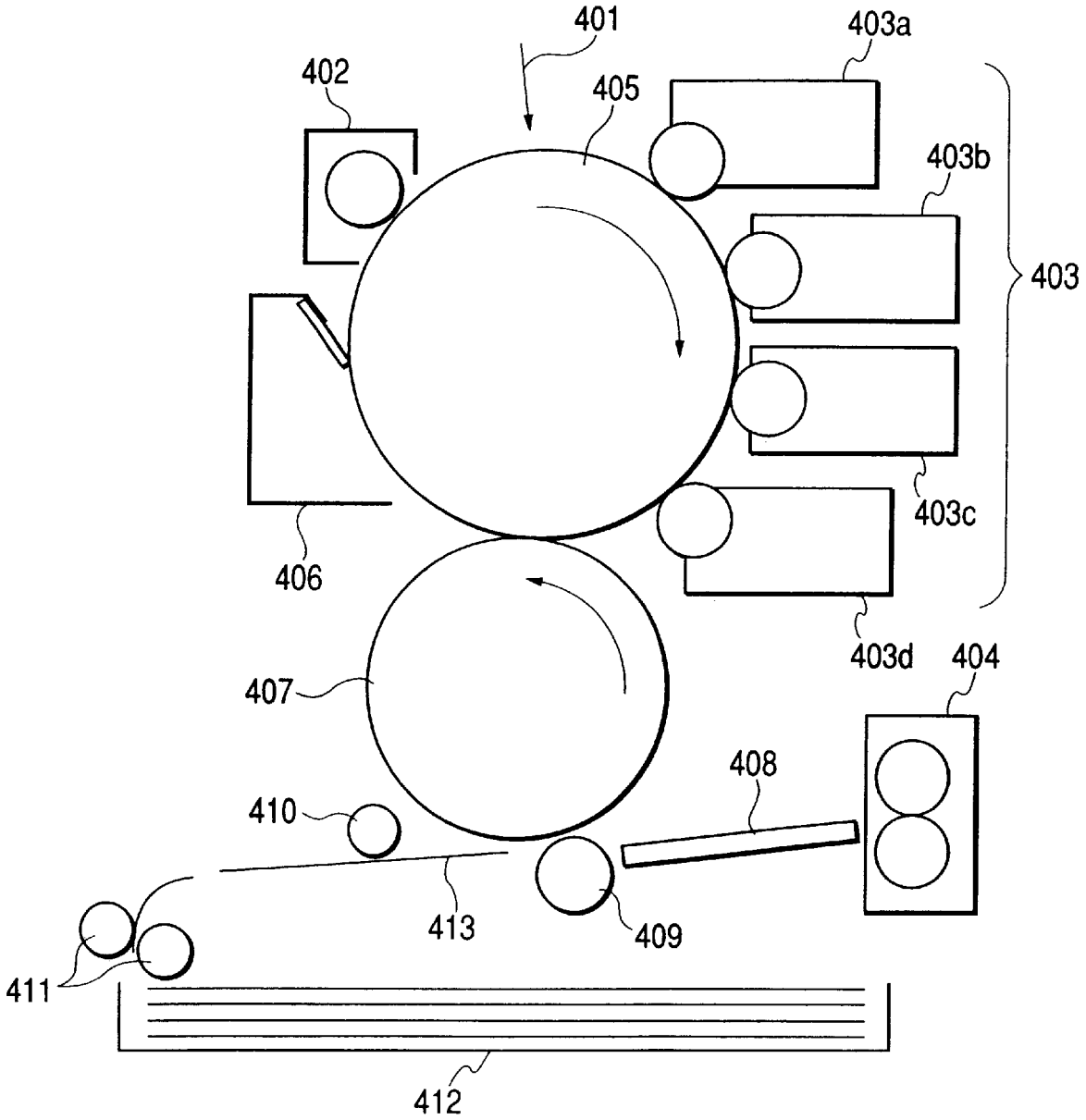
FIG. 4 schematically illustrates another full-color image-forming apparatus that can preferably make use of the magnetic particles for charging of the present invention.
Figure 5:
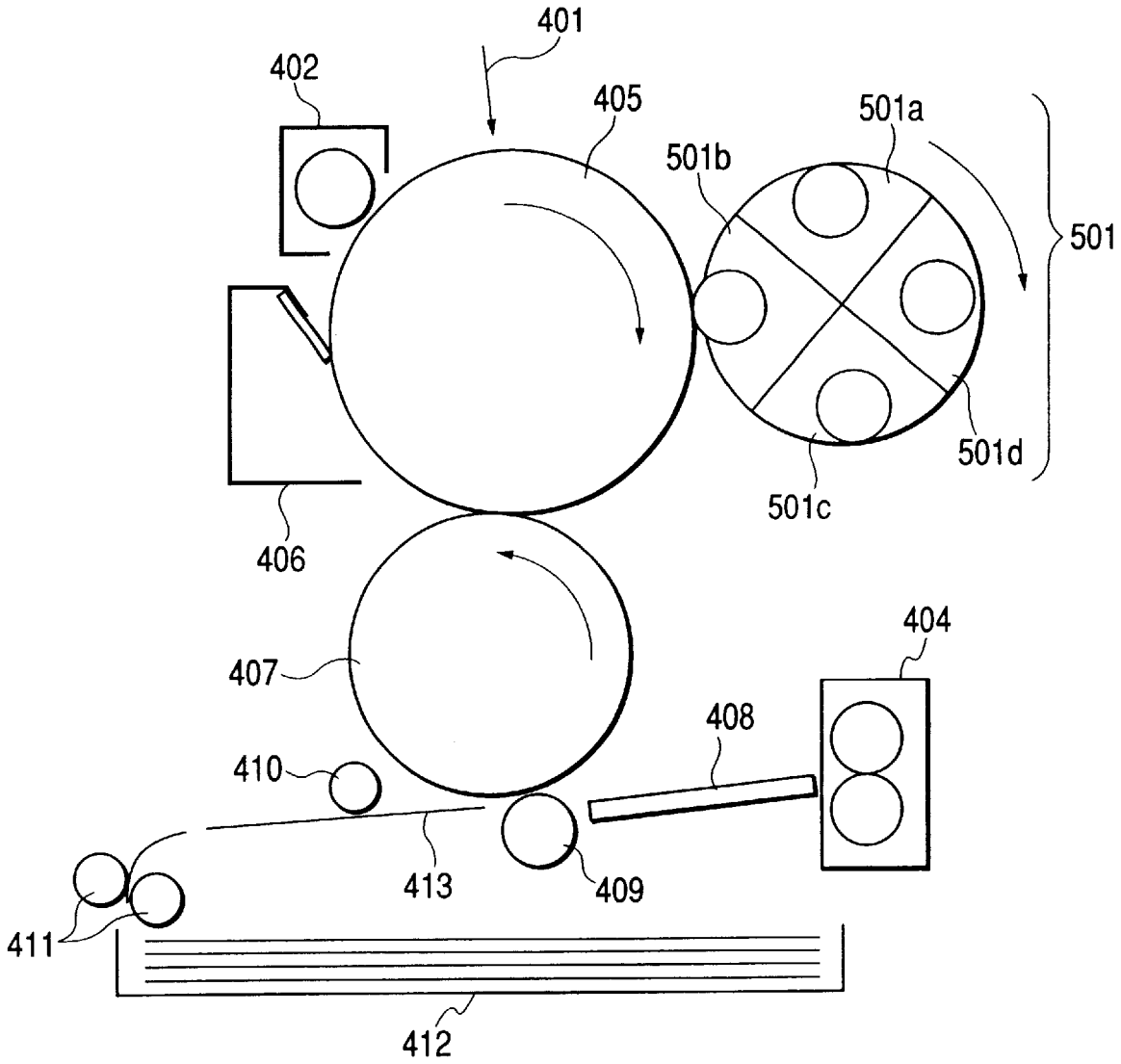
FIG. 5 schematically illustrates still another full-color image-forming apparatus that can preferably make use of the magnetic particles for charging of the present invention.

What may be given next is an apparatus so constructed that one image-bearing member is provided with a plurality of developing means arranged successively, corresponding to the kinds of color toners to be used, or having a such a movable construction that development using a plurality of developing assemblies can be made on this image-bearing member. FIGS. 4 and 5 show examples.

In FIG. 4, reference numeral 401 denotes exposure light; and 402, a charging means (primary charging assembly) making use of the magnetic particles for charging of the present invention. Also, reference numeral 403 denotes a developing means constituted of developing assemblies 403*a* to 403*d* for making development using yellow, cyan, magenta and black color toners. Still also, reference numeral 404 denotes a fixing assembly; 405, a photosensitive member; 406, a photosensitive member cleaning assembly; 407 a transfer member; 408, a transfer medium transport means; 409, a transfer means; 410, a resist roller; 411, a pick-up roller; 412, a transfer medium cassette; and 413, a transfer medium guide.

In FIG. 5, reference numeral 501 denotes a developing assembly unit constituted of developing assemblies 501*a* to 501*d* for making development using yellow, cyan, magenta and black color toners used to form full-color images. Reference numerals 401 to 412 denote the same as those in FIG. 4.

In the present invention, in the toner used in the developing means, toner particles produced by either of a pulverization process and a polymerization process may be used. Toner particles produced by polymerization, in particular, suspension polymerization may preferably be used. Seed polymerization, in which monomers are further adsorbed on polymer particles once obtained and thereafter a polymerization initiator is added to effect polymerization, may also preferably be used in the present invention.

In the production of toner particles by pulverization, constituent materials such as a binder resin, a colorant and a charge control agent are thoroughly mixed using a ball mill or other mixing machine, and the mixture obtained is well melt-kneaded using a heat kneading machine such as a heating roll, a kneader or an extruder. The kneaded product obtained is cooled to solidify, followed by mechanical pulverization and classification to obtain toner particles. More preferred are toner particles having been subjected to spherical treatment by applying hot air treatment or mechanical impact after the classification.

As types of the binder resin used in the production of toner particles by pulverization, usable binder resins are, egg., homopolymers of styrene or derivatives thereof such as polystyrene, poly-p-chlorostyrene and polyvinyltoluene; styrene copolymers such as a styrene-p-chlorostyrene copolymer, a styrene-vinyltoluene copolymer, a styrene-vinylnaphthalene copolymer, a styrene-acrylate copolymer, a styrene-methacrylate copolymer, a styrene-methyl α-chloromethacrylate copolymer, a styrene-acrylonitrile copolymer, a styrene-methyl vinyl ether copolymer, a styrene-ethyl vinyl ether copolymer, a styrene-methyl vinyl ketone copolymer, a styrene-butadiene copolymer, a styrene-isoprene copolymer and a styrene-acrylonitrile-indene copolymer; polyvinyl chloride, phenolic resins, natural-resin-modified phenolic resins, natural-resin-modified maleic acid resins, acrylic resins, methacrylic resins, polyvinyl acetate, silicone resins, polyester resins, polyurethanes, polyamide resins, furan resins, epoxy resins, xylene resins, polyvinyl butyral, terpene resins, cumarone indene resins, and petroleum resins. Cross-linked styrene resins are also preferred binder resins.

When the suspension polymerization is employed for producing toner particles, the toner particles can be produced specifically by a production process as described below. A monomer composition prepared by adding in a polymerizable monomer a low-softening substance release agent, a colorant, a charge control agent, a polymerization initiator and other additives, and uniformly dissolving or dispersing them by means of a homogenizer or an ultrasonic dispersion machine, is dispersed in an aqueous medium containing a dispersant, by means of a conventional stirrer or a stirrer such as a homomixer or homogenizer. Granulation is carried out preferably while controlling the stirring speed and time so that droplets formed of the monomer composition can have the desired toner particle size. After the granulation, stirring may be carried out to such an extent that the state of particles is maintained and the particles can be prevented from settling by the acton of the dispersant. The polymerization may be carried out at a polymerization temperature set at 40° C. or above, usually from 50 to 90° C. At the latter half of the polymerization, the temperature may be raised, and also the aqueous medium may be removed in part at the latter half of the reaction or after the reaction has been completed, in order to remove unreacted polymerizable monomers, by-products and so forth. After the reaction has been completed, the toner particles formed are collected by washing and filtration, followed by drying. In the suspension polymerization, water, may preferably be used as the dispersion medium usually in an amount of from 300 to 3,000 parts by weight based on 100 parts by weight of the monomer composition.

In the present invention, toner particles having a core/shell structure wherein a low-softening substance is covered with a shell resin may preferably be used. This is because the core/shell structure can act to impart anti-blocking properties to the toner without damaging its good fixing performance, and, compared with polymerization toner particles formed as a bulk having no cores, any residual monomers can be removed with ease in the step of post treatment after the step of polymerization.

The toner particles having such a core/shell structure can be obtained by setting the polarity of materials in the aqueous medium in such a way that the polarity of the low-softening substance is smaller than that of the chief monomer. Stated specifically, as the low-softening substance, usable are paraffin wax, microcrystalline wax, polyolefin wax, Fischer-Tropsch wax, carnauba wax, amide waxes, alcohols, higher fatty acids, acid amide waxes, ester waxes, ketones, hardened castor oil, vegetable types, animal types, mineral types, petrolatum, and derivatives of these or grafted or blocked compounds of these.

The low-softening substance may preferably be added in an amount of from 5 to 30% by weight based on the weight of the toner particles. If it is added in an amount less than 5% by weight, a load may be applied when the residual monomers are removed as described previously. If on the other hand it is more than 30% by weight, toner particles tend to coalesce at the time of granulation when produced by polymerization, and those having a broad particle size distribution tend to be formed, which are unsuitable for the present invention.

The resin used to form the shell may preferably be a styrene-acrylate or methacrylate copolymer, a polyester resin, an epoxy resin or a styrene-butadiene copolymer. As monomers for obtaining styrene type copolymers, monomers as listed below may preferably be used. Preferably usable are styrene; styrene type monomers such as o-, m- or p-methylstyrene, and m- or p-ethylstyrene; acrylic or methacrylic acid ester monomers such as methyl acrylate or methacrylate, ethyl acrylate or methacrylate, propyl acrylate or methacrylate, butyl acrylate or methacrylate, octyl acrylate or methacrylate, dodecyl acrylate or methacrylate, stearyl acrylate or methacrylate, behenyl acrylate or methacryiate, 2-ethylhexyl acrylate or methacrylate, dimethylaminoethyl acrylate or methacrylate, and diethylaminoethyl acrylate or methacrylate; and olefin monomers such as butadiene, isoprene, cyclohexene, acrylo- or methacrylonitrile and acrylic acid amide. Any of these may be used alone, or usually used in the form of an appropriate mixture of monomers so mixed that the theoretical glass transition temperature (Tg) as described in a publication POLYMER HANDBOOK, 2nd Edition III, pp.139–192 (John Wiley & Sons, Inc.) ranges from 40 to 75° C. If the theoretical glass transition temperature is lower than 40° C., problems may arise in respect of storage stability or running stability of the toner. If on the other hand it is higher than 75° C., the fixing point of the toner may become higher. Especially in the case of color toners used to form full-color images, the color mixing performance of the respective color toners at the time of fixing may lower, resulting in a poor color reproducibility, and also the transparency of OHP images may greatly lower. Thus, such temperatures are not preferable in view of high image quality.

Molecular weight of the shell resin is measured by GPC (gel permeation chromatography). As a specific method for measurement by GPC, the toner is beforehand extracted with a toluene solvent for 20 hours by means of a Soxhlet extractor, and thereafter the toluene is evaporated by means of a rotary evaporator, followed by addition of an organic solvent capable of dissolving the low-softening substance but dissolving no shell resin (e.g., chloroform), to thoroughly carry out washing. Thereafter, the solution is dissolved in THF (tetrahydrofuran), and then filtered with a solvent-resistant membrane filter of 0.3 μm in pore diameter to obtain a sample. Molecular weight of the sample is measured using a detector 150C, manufactured by Waters Co. As column constitution, A-801, A-802, A-803, A-804, A-805, A-806 and A-807, available from Showa Denko K.K., are connected, and molecular weight distribution can be measured using a calibration curve of a standard polystyrene resin. The resin component obtained may preferably have a number average molecular weight (Mn) of from 5,000 to 1,000,000, and a shell resin standing 2 to 100 as the ratio of weight average molecular weight (Mw) to number average molecular weight (Mn), Mw/Mn, is preferred.

In the present invention, when the toner particles having the core/shell structure are produced, in order to encapsulate the low-softening substance with the shell resin, it is particularly preferable to further add a polar resin in addition to the shell resin. As the polar resin used in the present invention, copolymers of styrene with acrylic or methacrylic acid, maleic acid copolymers, polyester resins, saturated polyester resins and epoxy resins are preferably used. The polar resin may particularly preferably be those not containing in the molecule any unsaturated groups that may react with polymerizable monomers. If a polar resin having such unsaturated groups is contained, cross-linking reaction with the polymerizable monomers that form the shell resin takes place, so that the shell resin comes to have too high a molecular weight for the toners for forming full-color images and is disadvantageous for color mixture of four color toners. Thus, such a resin is not preferable.

In the present invention, the surfaces of the toner particles may further be provided with an outermost shell resin layer.

Such an outermost shell resin layer may preferably have a glass transition temperature so designed as to be higher than the glass transition temperature of the shell resin in order to more improve blocking resistance. The outermost shell resin layer may also preferably be cross-linked to such an extent that the fixing performance is not damaged. The outermost shell resin layer may preferably be incorporated with a polar resin or a charge control agent in order to improve charging performance.

There are no particular limitations on how to provide the outermost shell resin layer. For example, it may be provided by a method including the following.

1) A method in which, at the latter half or after the completion of polymerization reaction, a monomer composition prepared by dissolving or dispersing the polar resin, the charge control agent, a cross-linking agent and so forth as occasion calls is added, and adsorbed on polymerization particles, followed by addition of a polymerization initiator to carry out polymerization.
2) A method in which emulsion polymerization particles or soap-free polymerization particles produced from a monomer composition containing the polar resin, the charge control agent, a cross-linking agent and so forth as occasion calls are added in the reaction system, and are caused to cohere to the surfaces of polymerization particles, optionally followed by heating to fix them.
3) A method in which emulsion polymerization particles or soap-free polymerization particles produced from a monomer composition containing the polar resin, the charge control agent, a cross-linking agent and so forth as occasion calls are mechanically caused to fix to the surfaces of toner particles.

As a specific method by which the low-softening substance is encapsulated into toner particles, a low-softening substance whose material polarity in an aqueous dispersion medium is set smaller than the chief monomer may be used and also a small amount of resin or monomer with a greater polarity may be added. Thus, the toner particles having core/shell structure can be obtained.

The particle size distribution and particle diameter of the toner particles may be controlled by a method in which the types and amounts of slightly water soluble inorganic salts or dispersants having the action of protective colloids are changed, or by controlling mechanical apparatus conditions, for example, stirring conditions such as rotor peripheral speed, pass times and stirring blade shapes, and the shape of vessels or the solid matter concentration in aqueous solutions, whereby a toner with a desired particle size can be obtained.

As the binder resin for the toner used in pressure fixing, it may include low-molecular weight polyethylene, low-molecular weight polypropylene, an ethylene-viny acetate copolymer, an ethylene-acrylate copolymer, higher fatty acids, polyamide resins, and polyester resins. Any of these may be used alone or in the form of a mixture. In particular, in the present invention, those having neither polymerization inhibitory action nor solubilizates in aqueous mediums are preferred when the polymerization process is used as the toner particle production process.

In the present invention, the yellow, magenta, cyan and black toner particles may preferably have a weight-average particle diameter of from 2 to 9 $\mu$m in order to faithfully develop more minute latent image dots to achieve a high image quality, and from 3 to 9 $\mu$m in order to achieve a high image quality and prevent fog and toner scatter. Toner particles having a weight-average particle diameter smaller than 2 $\mu$m may have a low transfer efficiency to make the transfer residual toner remain on the photosensitive member in a large quantity, and also tend to cause non-uniform images due to faulty transfer. Thus, such toner particles are not preferable for the toner used in the present invention. If on the other hand the toner particles have a weight-average particle diameter larger than 9 $\mu$m, spots around character or line images tend to occur.

In the present invention, the toner particles may preferably have a shape factor SF-1 of from 100 to 140 and a shape factor SF-2 of from 100 to 120.

As the charge control agent used in the present invention, any known lagents may be used. In the case of color toners, it is especially preferable to use charge control agents that are colorless, make toner charging speed higher and are capable of stably maintaining a constant charge quantity. When the direct polymerization is used in the present invention to obtain the toner particles, charge control agents having neither polymerization inhibitory action nor solubilizates in aqueous mediums are particularly preferred. As specific compounds, they may include, as negative charge control agents, metal compounds of salicylic acid, naphthoic acid and dicarboxylic acids, polymer type compounds having sulfonic acid or carboxylic acid in the side chain, boron compounds, urea compounds, silicon compounds, and carixarene. As positive charge control agents, they may include quaternary ammonium salts, polymer type compounds having such a quaternary ammonium salt in the side chain, guanidine compounds, and imidazole compounds. Any of the above charge control agents may preferably be used in the form of fine particles, where such charge control agents may preferably have a number-average particle diameter of 2 $\mu$m or smaller, and more preferably 1 m or smaller. The charge control agent may preferably be used in a amount of from 0.05 to 5 parts by weight based on 100 parts by weight of the binder resin. In the present invention, however, the addition of the charge control agent is not essential. In the case when two-component development is employed, the triboelectric charging with a carrier may be utilized, and also in the case when non-magnetic one-component blade coating development is employed, the triboelectric charging with a blade member or sleeve member may intentionally be utilized. In either case, the charge control agent need not necessarily be contained in the toner particles.

When the polymerization is used to produce the toner particles in the present invention, the polymerization initiator may include, e.g., azo type polymerization initiators such as 2,2'-azobis-(2,4-dimethylvaleronitrile), 2,2'-azobisisobutyronitrile), 1,1'-azobis-(cyclohexane-1-carbonitrile), 2,2'-azobis-4-methoxy-2,4-dimethylvaleronitrile and azobisisobutyronitrile; and peroxide type polymerization initiators such as benzoyl peroxide, methyl ethyl ketone peroxide, diisopropyl peroxycarbonate, cumene hydroperoxide, 2,4-dichlorobenzoyl peroxide and lauroyl peroxide. The polymerization initiator may commonly be used in an amount of from 0.5 to 20% by weight based on the weight of the polymerizable monomers, which varies depending on the intended degree of polymerization. The polymerization initiator may a little vary in type depending on the methods for polymerization, and may be used alone or in the form of a mixture, making reference to its 10-hour half-life period temperature.

In order to control the degree of polymerization, any known cross-linking agent, chain transfer agent and polymerization inhibitor may further be added.

The dispersant may include, e.g., as inorganic oxides, tricalcium phosphate, magnesium phosphate, aluminum phosphate, zinc phosphate, calcium carbonate, magnesium carbonate, calcium hydroxide, magnesium hydroxide, aluminum hydroxide, calcium metasilicate, calcium sulfate, barium sulfate, bentonite, silica, alumina, magnetic materials and ferrite. As organic compounds, it may include, e.g., polyvinyl alcohol, gelatin, methyl cellulose, methyl hydroxypropyl cellulose, ethyl cellulose, carboxymethyl cellulose sodium salt, and starch. Any of these dispersants may preferably be used in an amount of from 0.2 to 10.0 parts by weight based on 100 parts by weight of the polymerizable monomer.

As these dispersants, those commercially available may be used as they are. In order to obtain dispersed particles having a fine and uniform particle size, however, fine particles of the inorganic compound may be formed in the dispersion medium under high-speed agitation. For example, in the case of tricalcium phosphate, an aqueous sodium phosphate solution and an aqueous calcium chloride solution may be mixed under high-speed agitation, whereby a fine-particle dispersant preferable for the suspension polymerization can be obtained. Also, in order to make the particles of these dispersants finer, 0.001 to 0.1% by weight of a surface active agent may be used in combination. Stated specifically, commercially available nonionic, anionic or cationic surface active agents can be used. For example, those preferably used are sodium dodecyl sulfate, sodium tetradecyl sulfate, sodium pentadecyl sulfate, sodium octyl sulfate, sodium oleate, sodium laurate, potassium stearate and calcium oleate.

As the colorant used in the present invention, carbon black, magnetic materials, and colorants toned in black by the use of yellow, magenta and cyan colorants shown below may be used as black colorants.

As the yellow colorant, condensation azo compounds, isoindolinone compounds, anthraquinone compounds, azo metal complexes, methine compounds and allylamide compounds are used. Stated specifically, C.I. Pigment Yellow 12, 13, 14, 15, 17, 62, 74, 83, 93, 94, 95, 97, 109, 110, 111, 120, 127, 128, 129, 147, 168, 174, 176, 180, 181 and 191 are preferably used.

As the magenta colorant, condensation azo compounds, diketopyroropyyrole compounds, anthraquinone compounds, quinacridone compounds, basic dye lake compounds, naphthol compounds, benzimidazolone compounds, thioindigo compounds and perylene compounds are used. Stated specifically, C.I. Pigment Red 2, 3, 5, 6, 7, 23, 48:2, 48:3, 48:4, 57:1, 81:1, 144, 146, 166, 169, 177, 184, 185, 202, 206, 220, 221 and 254 are particularly preferred.

As the cyan colorant, copper phthalocyanine compounds and derivatives thereof, anthraquinone compounds and basic dye lake compounds may be used. Stated specifically, C.I. Pigment Blue 1, 7, 15, 15:1, 15:2, 15:3, 15:4, 60, 62 and 66 may particularly preferably be used.

Any of these colorants may be used alone, in the form of a mixture, or further in the state of a solid solution. The colorants used in the present invention are selected taking account of hue angle, chroma, brightness, weatherability, transparency on OHP films and dispersibility in toner particles. The colorant may be added in an an amount of from 1 to 20 parts by weight based on 100 parts by weight of the binder resin.

External additives to toner, usable in the present invention may include oxides such as alumina, titanium oxide, silica, zirconium oxide and magnesium oxide, and besides silicon carbide, silicon nitride, boron nitride, aluminum nitride, magnesium carbonate and organosilicon compounds.

Of these, as inorganic oxide fine particles, fine particles of alumina; titanium oxide, zirconium oxide or magnesium oxide, or silica-treated fine particles of any of these are preferred because they can more stabilize the charging of toner without dependence on temperature and humidity. Also, fine particles of alumina or titanium oxide, or silica-treated fine particles of any of these are preferred in order to improve the fluidity of toner.

The inorganic oxide fine powder may preferably be those having been subjected to hydrophobic treatment, in order for the toner to have less environmental dependence of its charge quantity on temperature and humidity and in order to prevent the fine particles from coming off the toner particle surfaces. An agent for this hydrophobic treatment may include, e.g., coupling agents such as silane coupling agent, titanium coupling agent and aluminum coupling agent, and oils such as silicone oil, fluorine type oils and various modified oils. Of these hydrophobic treating agents, coupling agents are particularly preferred in view of stabilizing toner charging and providing fluidity.

The carrier which may be used in the present invention may preferably have a volume resistivity of from $10^9$ to $10^{15}$ Ω·cm. It may more preferably have a volume resistivity of from $10^{13}$ to $10^{15}$ Ω·cm. If the carrier has a volume resistivity too lower than the lower limit of the above range, its resistance is so low that the development bias may be injected at the developing zone, resulting in the disorder of latent images. If on the other hand the carrier has a volume resistivity too higher than the upper limit of the above range, the carrier itself may undergo charge-up to tend to cause a lowering of the fluidity-providing performance of the toner supplied.

Carriers preferably usable in the present invention are magnetic-powder dispersed type resin carriers prepared by dispersing magnetic powder such as iron powder or ferrite iron oxide powder in a resin, or ferrite carriers containing Mn, Cu, Zn, Ni, Sr or Mg.

The resin in which the magnetic powder is to be dispersed may include styrene-acrylic or methacrylic copolymers, polyester, resins, epoxy resins, a styrene-butadiene copolymer, acido resins and melamine resins. Also, the above carriers may preferably be those having been coated with silicone resin, acrylic resin or fluorine resin in order to prevent toner-spent.

EXAMPLES

The present invention will be described below in greater detail by giving Examples. The present invention is by no means limited to these Examples.

Magnetic-particle Production Example 1

To 100 parts by weight of an oxide composed chiefly of $Fe_2O_3$ (53 mole %), CuO (23.5 mole %) and Zno (23.5 mole %), 0.05 part by weight of phosphorus was added, and these were pulverized and blended, followed by addition of water, a dispersant and a binder to form a slurry. This slurry was granulated by spray drying, and the granulated product obtained was fired at 1,170° C. to obtain CuZn ferrite. After this firing, disintegration and classification were carried out to obtain spherical magnetic particles 1 having an average particle diameter of 25 μm. The minor-axis length/major-axis length standard deviations of magnetic particles having a maximum chord length of 5 μm or larger and those of from 5 to 20 μm were 0.05 and 0.06, respectively.

The magnetic particles 1 thus obtained showed a magnetization of 57 $Am^2/kg$ (57 emu/g) under application of a magnetic field of $8\times10^4$ A/m (1 kOe).

Magnetic-particle Production Example 2

To 100 parts by weight of an oxide composed chiefly of $Fe_2O_3$ (53 mole %), MnO (32 mole %) and MgO (15 mole %), 0.3 part by weight of phosphorus was added, and these were pulverized and blended, followed by addition of water, a dispersant and a binder to form a slurry. This slurry was granulated by spray drying, and the granulated product obtained was fired in an oxygen-partial-pressure-adjusted electric furnace to obtain MnMg ferrite. After this firing, disintegration and classification were carried out to obtain spherical magnetic particles 2 having an average particle diameter of 30 μm. The minor-axis length/major-axis length standard deviations of magnetic particles having a maximum chord length of 5 μm or larger and those of from 5 to 20 μm were 0.05 and 0.06, respectively.

The magnetic particles 2 thus obtained showed a magnetization of 57 $Am^2/kg$ (57 emu/g) like that in Production Example 1, under application of a magnetic field of $8\times10^4$ A/m (1 kOe).

Magnetic-particle Production Example 3

The granulation by spray drying in Magnetic-particle Production Example 1 was repeated but adjusting conditions therefor, followed by firing and disintegration to obtain spherical magnetic particles having an average particle diameter of about 70 μm. This product was further pulverized by means of a vibration mill to make particle shape irregular, followed by classification to make the particles have an average particle diameter of 35 μm to obtain magnetic particles 3.

The minor-axis length/major-axis length standard deviations of magnetic particles having a maximum chord length of 5 μm or larger and those of from 5 to 20 μm were 0.13 and 0.14, respectively.

The magnetic particles 3 thus obtained showed a magnetization of 57 $Am^2/kg$ (57 emu/g) under application of a magnetic field of $8\times10^4$ A/m (1 kOe).

Developer Production Example 1

100 parts by weight of polyester resin, 2 parts by weight of a metal-containing azo dye, 3.5 parts by weight of low-molecular weight polypropylene and 5 parts by weight of carbon black were dry-process blended, followed by kneading by means of a twin-screw extruder set at 150° C. The kneaded product obtained was air-cooled, and thereafter finely pulverized by means of an air-stream pulverizer, further followed by air classification to make adjustment of particle size distribution to obtain a toner classified product. To 100 parts by weight of this toner classified product, hydrophobic-treated titanium oxide and silica were externally added in an amount of 1 part by weight for each to produce a black toner having an average particle diameter of 7 μm.

A development carrier of a developer was produced in the following way. Phenol/formaldehyde monomers (weight ratio: 50:50) were mixed and dispersed in an aqueous medium. Thereafter, in 100 parts by weight of the monomer mixture, 600 parts by weight of magnetic powder prepared by subjecting magnetite particles surface-treated with alumina to hydrophobic treatment with isopropoxytriisostearoyl titanate and 400 parts by weight of non-magnetic hematite particles having been subjected to hydrophobic treatment with isopropoxytriisostearoyl titanate were uniformly dispersed. The monomers were polymerized while adding ammonia appropriately to the dispersion, to obtain spherical magnetic resin carrier cores having encapsulated magnetic particles therein. On 100 parts by weight of the spherical magnetic resin carrier cores, 0.5 part by weight of acrylic resin was coated to obtain a development-purpose carrier 1. This carrier had an average particle diameter of 40 μm and a volume resistivity of $4\times10^{13}$ Ω·cm.

The above toner and development-purpose carrier 1 were blended in a proportion of 7:100 in weight ratio to obtain a developer 1.

Developer Production Example 2

100 parts by weight of polyester resin, 4 parts by weight of a chromium compound of di-tertiary-butylsalicylic acid and 4 parts by weight of a diaryl type yellow pigment (C.I. Pigment Yellow 17) were pre-blended, followed by kneading by means of a twin-screw extruder in the same manner as in the production of the black toner. The kneaded product obtained was air-cooled, and thereafter finely pulverized by means of an air-stream pulverizer, followed by air classification to make adjustment of particle size distribution to obtain a toner classified product. To 100 parts by weight of this toner classified product, hydrophobic-treated titanium oxide and silica were externally added in an amount of 1 part by weight for each to produce a toner having an average particle diameter of 6.8 μm.

This toner and the development-purpose carrier 1 obtained in Developer Production Example 1 were blended in a proportion of 7:100 in weight ratio to obtain a developer 2.

Image-bearing Member Production Example

On an aluminum cylinder of 30 mm in diameter and 1.0 mm in wall thickness, functional layers were superposingly formed to produce an OPC photosensitive member. The layers superposingly formed are herein designated as first, second, third, fourth and fifth layers in the order from the aluminum cylinder side.

The first layer is a subbing layer. In order to level defects and so forth of the aluminum cylinder and also to prevent moirés from being caused by the reflection of laser exposure light, a conductive layer of 20 μm thick was provided.

The second layer is a positive-charge injection blocking layer. In order that positive electric charges injected from the aluminum cylinder side can be prevented from cancelling negative electric charges produced by charging on the photosensitive member surface, a layer comprised of Amilan resin and methoxymethylated nylon, adjusted to $6\times10^6$ Ω·cm in volume resistivity, was formed in a thickness of about 1 μm.

The third layer is a charge generation layer. In order to generate positive-negative electric-charge pairs by laser exposure, a layer with a disazo pigment dispersed therein was formed in a thickness of about 0.5 μm.

The fourth layer is a charge transport layer. A p-type semiconductor layer was formed, comprising polycarbonate resin with hydrazone dispersed therein. This layer has the function to transport to the photosensitive member surface the positive electric charges generated in the charge generation layer, and the negative electric charges produced by charging on the photosensitive member surface can not move through this layer.

The fifth layer is a charge injection layer. This charge injection layer is a resin layer comprising a photocurable acrylic resin with tin oxide dispersed therein and having a conductivity. The tin oxide was ultrafine particles having an average particle diameter of about 0.03 μm, doped with antimony to make conductive, which were dispersed in an amount of 180 parts by weight based on 100 parts by weight of the photocurable acrylic resin. The layer had a resistance of $6\times10^{12}$ Ω·cm. In the charge injection layer, 20 parts by weight of polytetrafluoroethylene resin particles and 1 part by weight of a dispersant were dispersed for the purpose of improving surface lubricity.

Example 1

Production Example 1 of Magnetic Particles for Charging

On 100 parts by weight of the magnetic particles 3, 0.15 part by weight of a titanium type coupling agent, isopropoxytitanium tristearate, was wet-process coated at 120° C. with stirring in a coating vessel by the use of ethanol as a solvent. The temperature of the coating vessel was further raised to 220° C. to effect curing for 90 minutes, thus first surface coat layers were formed. Next, the temperature was dropped by air cooling to about room temperature. Thereafter, 0.10 part by weight of an aminosilane, N-(2-aminoethyl)-3-aminopropyltrimethoxysilane, was wet-process coated at 80° C. in the above coating vessel by the use of toluene as a solvent, further followed by curing at 170° C. for 90 minutes to form second surface coat layers, thus magnetic particles for charging, 1, were obtained. The magnetic particles for charging, 1, showed no change in the particle diameter, minor-axis length/major-axis length standard deviation and magnetic characteristics before and after the coating.

Examples 2 to 18

Production Examples 2 to 18 of Magnetic Particles for Charging

Magnetic particles for charging, 2 to 18, were obtained in the same manner as in Example 1 except that the magnetic particles were surface-treated under the conditions shown in Table 1. Material names corresponding to the abbreviations used in Table 1 for the treating agents of the first and second surface coat layers are shown,in Table 2.

Example 19

Production Example 19 of Magnetic Particles for Charging

On 100 parts by weight of the magnetic particles 2, a mixture of 0.10 part by weight of N-(2-aminoethyl)-3-aminopropyltrimethoxysilane and 0.10 part by weight of acrylic resin was wet-process coated (simultaneous coating) at 120° C. with stirring in a coating vessel by the use of toluene as a solvent. The temperature of the coating vessel was further raised to 170° C. to effect curing for 90 minutes to obtain magnetic particles for charging, 19.

Example 20

Production Example 20 of Magnetic Particles for Charging

Magnetic particles for charging, 20, were obtained in the same manner as in Example 19 except that the acrylic resin used therein was replaced with isopropoxytitanium tristearate.

A laser beam digital copying machine (GP55, manufactured by CANON INC.) was remodeled as shown in FIG. 2 and used as the image-forming apparatus. GP55 is a reverse development type digital copying machine basically having a corona charging assembly, a one-component jumping developing assembly, a corona transfer assembly, a blade type cleaning assembly and an exposure means and having a process speed of 150 mm/sec. This was adjusted to a process speed of 200 mm/sec, and was further remodeled in the following way.

The developing assembly was remodeled into a two-component magnetic-brush developing assembly to enable performance of cleaning-at-development. The developing assembly has a developing sleeve, a magnet roller provided stationarily inside the developing sleeve, an agitation screw for transporting a developer onto the developing sleeve while agitating the developer, and a regulation blade for forming a developer thin layer on the developing sleeve. The developing sleeve is so disposed that the proximate gap comes to be about 500 μm with respect to an image-bearing member at least at the time of development and is so set that it can perform development in contact, with the image-bearing member.

A DC voltage and an AC voltage are applied to the developing sleeve from a power source. In the present Example, a voltage of −500 V and a voltage of Vpp=1,500 V and Vf=2,000 Hz were applied as the DC voltage and the AC voltage, respectively.

The charging assembly is a magnetic-brush type charging assembly. A non-magnetic electrode sleeve (external diameter: 16 mm) provided internally with a stationary magnet is face-to-face rotated with respect to the image-bearing member. In the present Example, it was face-to-face rotated at a peripheral speed of 120% with respect to the rotational speed of the image-bearing member. Charging bias was DC −700 V/AC 700 Vpp (1 kHz).

As the image-bearing member, the one obtained in the above Image-bearing Member Production Example was used.

The cleaning assembly (a blade and a container) was removed so as to be remodeled into the cleanerless system (cleaning-at-development). Also, as the transfer assembly, a contact type transfer roller was set in and was constant-current controlled.

Example 21

The magnetic particles for charging, 1, produced in Example 1 were set to be held on the above charging assembly to make up a magnetic-brush charging assembly, and this was set in the above image-forming apparatus. Evaluation was made according to evaluation methods 1 and 2 shown below.

(Evaluation Method 1)

Using the developer 1, an A4-size 10%-character original was continuously copied on 30,000 sheets in breadthwise paper feed to make evaluation on the following items (1) to (4). On items (1) and (2), experiments were made in an environment of normal temperature and low humidity (23° C./5%RH; hereinafter "N/L environment"); and on items (3) and (4), in an environment of high temperature and high humidity (30° C./80%RH; hereinafter "H/H environment").

(1) Image fog caused by faulty charging was measured with a reflection densitometer. Using a reflection densitometer (TC-6MC, Tokyo Denshoku Technical Center) being in conformity with JIS Z8722 (the 0-to-45 degree method), a difference (%) in density before and after image reproduction was calculated and the value obtained was regarded as fog density. Evaluation ranks are shown in Table 3. As image quality, a fog density of less than 2% was judged to be of no problem in practical use.

(2) Uniformity of charging performance was confirmed by fine-line, reproducibility. Evaluation ranks are shown in Table 4.

(3) How toner scattered around the charging assembly and in the vicinity of the exposure assembly was visually observed, and also evaluation was made on any image disorder (fog) caused by toner scatter. Evaluation ranks are shown in Table 5.

(4) How the photosensitive member was scratched was visually examined, and evaluation was made by image quality. Evaluation ranks are shown in Table 6.

(Evaluation Method 2)

To make evaluation on changes in tints of images, the developer 2 (yellow developer) was loaded in the developing assembly of the above image-forming apparatus, and idle running was performed for 30 minutes using this image-forming apparatus. Thereafter, the value of development bias of the image-forming apparatus was variously changed to take copies having solid images with different densities. Using a spectrophotometer Sp68 (X-Rite Inc.), the color space was measured on each of L* (lightness), a* (chromaticity; red-green) and b* (chromaticity; yellow-blue), where the value of b* obtained when L* was 92.80±0.10 was represented by b1.

Next, the magnetic particles for charging were added to the developing assembly. The magnetic particles for charging were added in a proportion of 17 parts based on 100 parts of the developer 2. Idle running was performed for 30 minutes and thereafter images were reproduced in the same way. On the images formed, the color space was measured likewise, where the value of b* obtained when L* was 92.80±0.10 was represented by b2. The value of b1–b2 was used as an index of a change in tints which is ascribable to the magnetic particles for charging. Evaluation ranks are shown in Table 7.

The results of evaluation are shown in Table 8. As can be seen from the results, in the N/L environment, having severe conditions for the charging, the image fog was less than 0.5% and also fine lines were well reproducible. In the H/H environment, having severe conditions for triboelectricity-providing performance, the toner scatter was prevented and neither scratches on image-bearing member nor image disorder occurred. Also, the image-bearing member was kept from vibration and its noise was prevented.

In the evaluation on changes in tints where the yellow developer was used, the tints were prevented from changing and a good color reproducibility was confirmable, even though the magnetic particles were those produced by pulverization.

Thus, as can be seen from the foregoing, the toner scatter was prevented and uniform charging and high image quality were achieved. Also, the generation of ozone was also more restrained on the whole than conventional charging assemblies, bringing about an effect advantageous for environmental countermeasures.

The magnetic particles for charging, 1, was subjected to Soxhlet extraction with toluene and that with ethanol, followed by concentration to dryness. The resultant respective extracted components were chemically analyzed by IR (infrared spectroscopy) and H-NMR.

As the result, in the IR analysis, peaks of 3,360 $cm^{-1}$ ($NH_2$), 1,590 $cm^{-1}$ (NH) and 1,631 $cm^{-1}$ (amide) indicating that nitrogen was contained were obtained. A peak due to Si—O—Si indicating the presence of a silane was also obtained at 1,120 $cm^{-1}$. These distinctive peaks were equivalent to those in the measurement made using as a reference sample the second surface coating agent aminosilane, N-(2-aminoethyl)-3-aminopropyltrimethoxysilane.

Peaks indicating, carboxylates (carboxylic acid) were also obtained at 1,110 to 1,249 $cm^{-1}$, 1,710 $cm^{-1}$ and 1,735 $cm^{-1}$, and the H-NMR analysis revealed that the acid detected by IR was isopropyl ester. These distinctive peaks were equivalent to those in the measurement made using the first surface coating agent titanium type coupling:agent, isopropoxytitanium tristearate.

The central elements (Ti—O and Si—O) of the coupling agent were also detected by ESCA. From these facts, the titanium type coupling agent and aminosilane were confirmed by chemical analysis.

Next, the extraction with methanol was carried out with time to examine the rate of elution of the aminosilane component (to detect nitrogen components by IR and TOF-SIMS). As a result, a difference was found between the present magnetic particles for charging and the magnetic particles for charging, 20, produced by simultaneous coating. Thus, the difference coming from the manners of forming surface coat layers (two-stage coating and simultaneous coating) was also conformable.

Example 22

Evaluation was made in the same manner as in Example 21 except that the magnetic particles for charging, 1, were replaced with the magnetic particles for charging, 5. The results of evaluation are shown in Table 8. In Example 22, too, good results like those in Example 21 were obtainable in respect of uniform charging, prevention of toner scatter and image quality.

Example 23

Evaluation was made in the same manner as in Example 21 except that the magnetic particles for charging, 1, were replaced with the magnetic particles for charging, 8. The results of evaluation are shown in Table 8. In Example 23, too, good results like those in Example 21 were obtainable, except that slight scratches not affecting images occurred on the photosensitive member.

Examples 24 to 27

Evaluation was made in the same manner as in Example 21 except that, the magnetic particles for charging, 1, were replaced with the magnetic particles for charging, 2, 3, 4 and 6, respectively. The results of evaluation are shown in Table 8. In each Example, good results like those in Example 21 were obtainable.

Examples 28 to 31

Evaluation was made in the same manner as in Example 21 except that the magnetic particles for charging, 1, were replaced with the magnetic particles for charging, 7, 9, 10 and 11, respectively. The results of evaluation are shown in Table 8. In each Example, good results like those in Example 21 were obtainable, except that slight scratches not affecting images occurred on the photosensitive member.

Examples 32 & 33

Evaluation was made in the same manner as in Example 21 except that the magnetic particles for charging, 1, were replaced with the magnetic particles for charging, 12 and 13, respectively. The results of evaluation are shown in Table 8. In each Example, fog and toner scatter occurred slightly, since the acrylic resin was used in place of the coupling agent as the first surface coating agent of the magnetic particles for charging. However, any influence on the image quality was not seen, land also changes in tints were restrained to a low level, thus images having a sufficient quality were obtainable.

Example 34

Evaluation was made in the same manner as in Example 21 except that the magnetic particles for charging, 1, were replaced with the magnetic particles for charging, 14. The results of evaluation are shown in Table 8. In Example 34, fog and photosensitive member scratches were seen, since the silicone oil was used in place of the coupling agent as the first surface coating agent of the magnetic particles for charging. However, a minimum level for practical use was maintained.

Example 35

Evaluation was made in the same manner as in Example 21 except that the magnetic particles for charging, 1, were replaced with the magnetic particles for charging, 15. The results of evaluation are shown in Table 8. In Example 35, fog and toner scatter occurred slightly, since the acrylic resin was used in place of the coupling agent as the first surface coating agent of the magnetic particles for charging. However, any influence on the image quality was not seen, and also changes in tints were restrained to a low level, thus images having a sufficient quality were obtainable.

Example 36

Evaluation was made in the same manner as in Example 21 except that the magnetic particles for charging, 1, were replaced with the magnetic particles for charging, 16. The results of evaluation are shown in Table 8. In Example 36, compared with Example 34, improvements were seen in the prevention of fog and the prevention toner scatter, since N-(2-aminoethyl)-3-aminopropyltrimethoxysilane was used as the second surface coating agent of the magnetic particles for charging.

Example 37

Evaluation was made in the same manner as in Example 21 except that the magnetic particles for charging, 1, were replaced with the magnetic particles for charging, 17. The results of evaluation are shown in Table 8. In Example 37, since the silicone resin was used in place of the coupling agent as the first surface coating agent of the magnetic particles for charging, fog was seen and fine-line reproducibility was low, but on the minimum level for practical use. On the whole, images with small changes in tints and having no problems in practical use were obtainable.

Example 38

Evaluation was made in the same manner as in Example 21 except that the magnetic particles for charging, 1, were replaced with the magnetic particles for charging, 18. The results of evaluation are shown in Table 8. In Example 38, changes in tints were restrained, and fog and toner scatter were also restrained to a level not affecting image quality, thus images having a sufficient quality were obtainable.

Example 39

Evaluation was made in the same manner as in Example 21 except that the magnetic particles for charging, 1, were replaced with the magnetic particles for charging, 19. The results of evaluation are shown in Table 8. In Example 39, changes in tints and image fog occurred, but a minimum level for practical use was maintained.

Example 40

Evaluation was made in the same manner as in Example 21 except that the magnetic particles for charging, 1, were replaced with the magnetic particles for charging, 20. The results of evaluation are shown in Table 8. In Example 40, good results were obtainable in respect of the scratches on image-bearing member and the changes in tints. Also, although fog and toner scatter were seen to have occurred in partly, a minimum level for practical use was maintained.

Comparative Example 1

Evaluation was made in the same manner as in Example 21 except that the magnetic particles for charging, 1, were replaced with the magnetic particles 1. The results of evaluation are shown in Table 8. In Comparative Example 1, toner scatter occurred and the image-bearing member was abraded, resulting in a low image quality.

Comparative Production Example 1 of Magnetic Particles for Charging

On 100 parts by weight of the magnetic particles 1, 0.20 part by weight of polycarbonate resin was wet-process coated at 100° C. with stirring in a coating vessel by the use of toluene as a solvent. The temperature of the coating vessel was further raised to 120° C. to effect curing for 90 minutes. Thus, magnetic particles for charging, 21, were obtained.

Comparative Example 2

Evaluation was made in the same manner as in Example 21 except that the magnetic particles for charging, 1, were replaced with the magnetic particles 21. The results of evaluation are shown in Table 8. As can be seen from the results, toner scatter occurred and fine-line reproducibility was low.

According to the present invention, magnetic particles for charging can be provided which can prevent toner scatter and photosensitive member scratches and promises superior charging performance and service durability. Also, where the charging assembly holding the magnetic particles for charging of the present invention is set in the image-forming apparatus, the changes in tints of toner can be prevented and a high image quality can be achieved in addition to the superior charging performance and service durability.

In addition, according to the present invention, superior image characteristics can be imparted also in the image-forming apparatus employing the cleaning-at-development system. Hence, charging assemblies and image-forming apparatus can be provided which can keep ozone from being generated in the charging step and are advantageous for environmental countermeasures.

Magnetic-particle Production Example 4

| | |
|---|---|
| $Fe_2O_3$ | 54 mole % |
| MnO | 30 mole % |
| MgO | 16 mole % |

The above oxides were pulverized and blended by means of a ball mill, followed by addition of water, a dispersant and a binder to form a slurry. Thereafter, the slurry was granulated by spray drying. The granulated product obtained was, after appropriate classification, fired at 1,200° C. in an oxygen-concentration-adjusted atmosphere, and the fired product was disintegrated, followed by shape adjustment made by means of a ball mill to obtain ferrite powder whose minor-axis length/major-axis length standard deviations of magnetic: particles having a maximum chord length of 5 μm or larger and those of from 5 to 20 μm were 0.12 and 0.14, respectively, average particle diameter was 19 μm and volume resistivity was $4\times10^7$ Ω·cm. This was designated as magnetic particles 4.

Magnetic-particle Production Example 5

The procedure of Magnetic-particle Production Example 1 was repeated except for changing conditions for the shape adjustment made therein, to obtain ferrite powder whose minor-axis length/major-axis length standard deviations of magnetic particles having a maximum chord length of 5 μm or larger and those of from 5 to 20 μm were 0.09 and 0.11, respectively, average particle diameter was 22 μm and volume resistivity was $3\times10^7$ Ω·cm. This was designated as magnetic particles 5.

Magnetic-particle Comparative Production Example 2

Iron oxide was pulverized by means of a ball mill, followed by addition of a dispersant, a binder and water to form a slurry. Thereafter, the slurry was granulated by spray drying. The granulated product obtained was, after appropriate classification, fired in an oxygen-concentration-adjusted atmosphere, and the fired product was disintegrated, followed by shape adjustment made by means of a ball mill to obtain magnetite powder whose minor-axis length/major-axis length standard deviations of magnetic particles having a maximum chord length of 5 μm or larger and those of from 5 to 20 μm were 0.06 and 0.07, respectively, average particle diameter was 22 μm and volume resistivity was $4\times10^3$ Ω·cm. This was designated as magnetic particles 6.

Magnetic-particle Production Example 6

The procedure of Magnetic-particle Comparative Production Example 2 was repeated except for changing conditions for the shape adjustment made therein, to obtain magnetite powder whose minor-axis length/major-axis length standard deviations of magnetic particles having a maximum chord length of 5 μm or larger and those of from 5 to 20 μm were 0.11 and 0.13, respectively, and average particle diameter was 19 μm. This magnetite powder was subjected to oxidation treatment by heating it in oxygen to obtain magnetite powder having a volume resistivity of $4\times10^9$ Ω·cm. There was no difference in the minor-axis length/major-axis length standard deviation before and after the oxidation treatment. This was designated as magnetic particles 7.

Magnetic-particle Production Example 7

The magnetic particles 4 obtained in Magnetic-particle Production Example 4 were subjected to oxidation treatment by heating them in the air to obtain ferrite powder having a volume resistivity of $4\times10^8$ Ω·cm. There was no difference in the minor-axis length/major-axis length standard deviation before and after the oxidation treatment. This was designated as magnetic particles 8.

Magnetic-particle Production Example 8

The magnetic particles 4 obtained in Magnetic-particle Production Example 4 were subjected to reduction treatment by heating them in nitrogen to obtain ferrite powder having a volume resistivity of $7\times10^6$ Ω·cm. There was no difference in the minor-axis length/major-axis length standard deviation before and after the reduction treatment. This was designated as magnetic particles 9.

(Image-bearing Member)

On an aluminum cylinder of 30 mm in diameter and 0.75 mm in wall thickness, first to fifth functional layers were provided to produce a photosensitive member.

The first layer is a subbing layer. In order to level defects and so forth of the aluminum cylinder and also to prevent moirés from being caused by the reflection of laser exposure light, a conductive layer of about 20 μm thick was provide The second layer is a positive-charge injection blocking layer. In order that positive electric charges injected from,the aluminum cylinder side can be prevented from cancelling negative electric charges produced by charging on the photosensitive member surface, a layer comprised of Amilan resin and methoxymethylated nylon, adjusted to about $10^6$ Ω·cm in volume resistivity, was formed in a thickness of about 1 μm.

The third layer is a charge generation layer. In order to generate positive-negative electric-charge pairs by laser exposure, a layer with an oxytitanium phthalocyanine pigment dispersed therein was formed in a thickness of about 0.3 μm.

The fourth layer is a charge transport layer. A p-type semiconductor layer was formed, comprising polycarbonate resin with hydrazone dispersed therein. Hence, the negative electric charges produced by charging on the photosensitive member surface can not move through this layer, and only the positive electric charges generated in the charge generation layer can be transported to the photosensitive member surface. This fourth layer was formed in a thickness of 15 μm. The image-bearing member has a surface resistance of $3\times10^{15}$ Ω·cm in the case of the charge transport layer alone.

The fifth layer is a charge injection layer. This charge injection layer is formed of a photocurable acrylic resin with ultrafine $SnO_2$ particles dispersed therein. Stated specifically, $SnO_2$ particles having an average particle diameter of about 0.03 μm, doped with antimony to make low-resistance, were dispersed in an amount of 160 parts by weight based on 100 parts by weight of the photocurable acrylic resin, and further 18 parts by weight of polytetrafluoroethylene resin particles and 1.0 part by weight of a dispersant were further dispersed. This fifth layer was formed in a thickness of 3.5 μm. Thus, the image-bearing member came to have a surface resistance of $5\times10^{12}$ cm.

Cyan Toner Production Example

Into 710 parts by weight of ion-exchanged water, 450 parts by weight of an aqueous 0.1M $Na_3PO_4$ solution was introduced. The mixture formed was heated to 60° C., and thereafter stirred at 12,000 rpm by means of a TK-type homomixer (manufactured by Tokushukika Kogyo K.K.). Then, 68 parts by weight of an aqueous 1.0M $CaCl_2$ solution was slowly added thereto to obtain an aqueous medium containing calcium phosphate.

Next, 165 parts by weight of styrene and 35 parts by weight of n-butyl acrylate as monomers and 14 parts by weight of C.I. Pigment Blue 15:3 as a colorant were finely dispersed by means of a ball mill, and thereafter 2 parts by weight of a salicylic acid aluminum compound as a charge control agent, 10 parts by weight of saturated, polyester resin as a polar resin and 50 parts by weight of ester wax (melting point: 70° C.) as a release agent were added thereto and uniformly dissolved or dispersed at 12,000 rpm by means of a TK-type homomixer (manufactured by Tokushukika Kogyo K.K.) heated to 60° C. To the resultant mixture, 10 parts by weight of la polymerization initiator 2,2'-azobis (2,4-dimethylvaleronitrile) to prepare a polymerizable monomer composition.

Next, the polymerizable monomer composition was introduced into the above aqueous medium to granulate the polymerizable monomer composition with stirring for 10 minutes at 10,000 rpm by means of the TK-type homomixer in an atmosphere of $N_2$ at 60° C. Thereafter, with stirring using paddle stirring blades, the temperature was raised to 80° C. to carry out the reaction for 10 hours. After the polymerization reaction was completed, residual monomers were evaporated off under reduced pressure and the reaction mixture was cooled. Thereafter, hydrochloric acid was added to dissolve the calcium phosphate, followed by filtration, water washing and drying to obtain toner particles having a weight-average particle diameter of 6.5 μm, an SF-1 of 114 and an SF-2 of 107, and showing a sharp particle size:distribution.

To 100 parts by weight of the toner particles thus obtained, 1.0 part by weight of hydrophobic titanium oxide and 1.0 part by weight of hydrophobic fine silica powder were externally added to obtain a cyan toner.

(Production of Yellow, Magenta and Black Toners)

Yellow, magenta and black toners were produced in the same manner as Cyan Toner Production Example except for changing the pigment.

(Development Carrier Production Example)

Phenol/formaldehyde monomers (weight ratio: 50:50) were mixed and dispersed in an aqueous medium. Thereafter, in 100 parts by weight of the monomer mixture, 600 parts by weight of magnetic powder prepared by subjecting magnetite particles surface-treated with alumina to hydrophobic treatment with isopropoxytriisostearoyl titanate and 400 parts by weight of non-magnetic hematite particles having been subjected to hydrophobic treatment with isopropoxytriisostearoyl titanate were uniformly dispersed. The monomers were polymerized while adding ammonia appropriately, to the dispersion, to obtain spherical magnetic resin carrier cores having encapsulated magnetic particles therein.

On 100 parts by weight of the spherical magnetic resin carrier cores, 0.5 part by weight of acrylic resin was further coated to obtain a development-purpose carrier. This carrier had an average particle diameter of 40 μm and a volume resistivity of $4\times10^{13}$ Ω·cm.

Developer Production Example 3

Yellow, Magenta, Cyan and Black Developers

Each of the yellow, magenta, cyan and black toners and the development-purpose carrier 1 were blended in a proportion of 8:100 in weight ratio of toner/carrier to obtain developers.

(Image-forming Apparatus)

A laser beam digital copying machine (GP55, manufactured by CANON INC.) was made ready for use as the image-forming apparatus. This apparatus basically has a corona charging assembly as the charging means of the image-bearing member, a one-component developing assembly as the developing means, employing one-component jumping development, a corona transfer charging assembly as the transfer means, a blade type cleaning means and an exposure-before-charging means. Also, the charging assembly, cleaning means and image-bearing member are set as an integral-type one unit. The apparatus has a process speed of 150 mm/sec.

In the present Example, this digital copying machine was remodeled in the following way. First, it was so remodeled as to have a process speed of 200 mm/sec. Next, its developing part was so remodeled as to enable two-component development in place of the one-component jumping development. At the charging part, a conductive non-magnetic sleeve of 16 mm diameter internally provided with a magnet roller was further disposed to form a charging magnetic brush. The transfer means making use of the corona transfer charging assembly was further changed to a roller transfer system, and the exposure-before-charging means was removed.

The gap between the conductive sleeve and the image-bearing member at the charging zone was set to be 0.5 mm. As a development bias, a rectangular wave of 1,000 Vpp/3 kHz was superimposed on a DC component of −500 V. The cleaning blade was further removed to provide a cleanerless copying machine. Its schematic view is given in FIG. 2.

Example 41

First, magnetic particles for charging, 22, used in the present Example 41 were produced in the following way.

A stationary mixer having a stirrer and a heating means was kept at 100° C., and 100 parts by weight of the magnetic particles 4 and a toluene solution in which 0.3 part by weight of isopropoxytitanium tristearate was dissolved as the first surface coating agent were introduced thereinto ito carry out wet-process coating of the former with the latter. The temperature was raised to 180° C. to effect drying (curing) to form first surface coat layers, followed by leaving to cool. Next, a methanol dispersion in which 0.3 part by weight of aluminum 9-octadecenylacetoacetate diisopropoxide was dispersed as the second surface coating agent was added to carry out wet-process coating. The temperature was raised to 70° C. to effect drying (curing) to form second surface coat layers on the first surface coat layers. Thus, the magnetic particles for charging, 22, were obtained. The weight loss on heating of the magnetic particles for charging, 22, was 0.5% by weight. Incidentally, the isopropoxytitanium tristearate was soluble in the toluene and turned transparent amber, but was understood to be insoluble in the methanol as it became brownish-cloudy.

The magnetic particles for charging, 22, showed no difference in the minor-axis length/major-axis length standard deviation before and after the surface coating, and had a volume resistivity of $2\times10^7$ Ω·cm.

Conditions for producing the magnetic particles for charging which are used in the present Example and magnetic particles for charging which are used in Examples and Comparative Examples given later are shown in Table 9. Material names corresponding to the abbreviations used in Table 9 for the first and second surface coating agents are shown in Table 10.

Next, the above magnetic particles for charging were evaluated in the following way.

The above digital copying machine was used. The magnetic particles for charging were set to be held on the charging assembly in a coating density of 180 mg/cm$^2$ and the image-bearing member was set in. In order for the coating density to be in the above value, at least about 30 g of the magnetic particles for charging are required. The magnetic-brush charging assembly thus made up was rotated in the direction opposite to the rotation of the image-bearing member at the former's contact portion with the latter. Here, the charging assembly was rotated at a peripheral speed of 240 mm/sec.

Evaluation conditions were as follows: As a bias applied to the charging assembly, a DC voltage of applied voltage −700 V and a rectangular oscillating voltage of 700 Vpp at 1 kHz were applied. As to temperature and humidity, evaluation tests were made under conditions of 15° C./20%RH. As a development bias, a rectangular wave of 1,000 Vpp/3 kHz was superimposed on a DC component of −500 V.

Using the yellow developer, an image with seventeen gradations were copied. Thereafter, an image with an image area percentage of 0%, i.e., a solid white image was copied in a 1,000 sheet mode by five cycles, i.e., on 5,000 sheets under conditions of a rotational peripheral speed of 300 mm/sec. Thereafter, like the initial stage, the image with seventeen gradations were reproduced. Any difference in color space before and after this running was examined to make evaluation.

In the evaluation, Color Laser Copyer Paper (available from CANON SALES CO., INC.) was used. To evaluate the color space, SP68 spectrophotometer (manufactured by X-Rite Inc.) was used to measure L* (lightness), a* (chromaticity; red-green) and b* (chromaticity; yellow-blue). Here, the seventeen gradations were so selected as for the value of L* to be 92.80±0.10, and a difference in b* between images at the initial stage and those after 5,000-sheet copying was taken up. This difference is expressed as Δb*. The smaller the Δb* is, the smaller the change in hues is and hence the more preferable the images are from the viewpoint of color images.

As a result of the evaluation made using the magnetic particles for charging, 22, the above yellow developer and the above photosensitive member, the Δb* was 2. Results of the evaluation are shown in Table 11.

Example 42

A stationary mixer having a stirrer and a heating means was kept at 100° C., and 100 parts by weight of the magnetic particles 4 and a toluene solution in which 0.3 part by weight of isopropoxytitanium tristearate was dissolved as the first surface coating agent were introduced thereinto to carry out wet-process coating of the former with the latter. The temperature was raised to 180° C. to effect drying (curing) to form first surface coat layers, followed by leaving to cool. Next, an ethanol solution in which 0.3 part by weight of dodecyltrimethoxysilane was dissolved as the second surface coating agent was added to carry out wet-process coating. The temperature was raised to 70° C. to effect drying (curing) to form second surface coat layers on the first surface coat layers. Thus, the magnetic particles for charging, 23, were obtained. The weight loss on heating of the magnetic particles for charging, 23, was 0.5% by weight. Incidentally, the isopropoxytitanium tristearate was understood to be insoluble in the ethanol as it became brownish-cloudy.

The magnetic particles for charging, 23, showed no difference in the minor-axis length/major-axis length standard deviation before and after the surface coating, and had a volume resistivity of $5\times10^7$ μcm.

Evaluation was made on the magnetic particles for charging, 23, in the same manner as in Example 41. Results obtained are shown in Table 11.

Example 43

A stationary mixer having a stirrer and a heating means was kept at 100° C., and 100 parts by weight of the magnetic particles 4 and a toluene solution in which 0.3 part by weight of isopropoxytitanium tristearate was dissolved as the first surface coating agent were introduced thereinto to carry out wet-process coating of the former with the latter. The temperature was raised to 180° C. to effect drying (curing) to form first surface coat layers, followed by leaving to cool. Next, an ethanol solution in which 0.3 part by weight of n-propyltrimethoxysilane was dissolved as the second surface coating agent was added to carry out wet-process coating. The temperature was raised to 70° C. to effect drying (curing) to form second surface coat layers on the first surface coat layers. Thus, the magnetic particles for charging, 24, were obtained. The weight loss on heating of the magnetic particles for charging, 24, was 0.4% by weight.

The magnetic particles for charging, 24, showed no difference in the minor-axis length/major-axis length standard deviation before and after the surface coating, and had a volume resistivity of $6\times10^7$ Ω·cm.

Evaluation was made on the magnetic particles for charging, 24, in the same manner as in Example 41. Results obtained are shown in Table 11.

Example 44

Magnetic particles for charging, 25, were obtained in the same manner as in Example 43 except that ethanol was replaced with toluene. They showed no difference in the minor-axis length/major-axis length standard deviation before and after the surface coating, and had a volume resistivity of $6\times10^7$ Ω·cm.

Evaluation was made on the magnetic particles for charging, 25, in the same manner as in Example 41. Results obtained are shown in Table 11. The value of Δb* was 10, which was a little higher, but within the range of no problem in practical use. This was presumably because the toluene, in which the isopropoxytitanium tristearate was soluble, was used as the solvent when the second surface coat layers were formed.

Example 45

A stationary mixer having a stirrer and a heating means was kept at 100° C., and 100 parts by weight of the magnetic particles 4 and a toluene solution in which 0.3 part by weight of isopropoxytitanium tristearate was dissolved as the first surface coating agent were introduced thereinto to carry out wet-process coating of the former with the latter. The temperature was raised to 180° C. while removing the toluene, to effect drying (curing) to form first surface coat layers, followed by leaving to cool. Next, an ethanol solution in which 0.05 part by weight of n-propyltrimethoxysilane was dissolved as the second surface coating agent was added to carry out wet-process coating. The temperature was raised to 70° C. to effect drying (curing) to form second surface coat layers on the first surface coat layers. Thus, the magnetic particles for charging, 26, were obtained. The weight loss on heating of the magnetic particles for charging, 26, was:,0.3% by weight.

The magnetic particles for charging, 26, showed no difference in the minor-axis length/major-axis length standard deviation before and after the surface coating, and had a volume resistivity of $4\times10^7$ Ω·cm.

Evaluation was made on the magnetic particles for charging, 26, in the same manner as in Example 41. Results obtained are shown in Table 11.

Example 46

A stationary mixer having a stirrer and a heating means was kept at 100° C., and 100 parts by weight of the magnetic particles 4 and a toluene dispersion in which 0.3 part by weight of aluminum 9-octadecenylacetoacetate diisopropoxide was dispersed as the first surface coating agent were introduced thereinto to carry out wet-process coating of the former with the latter. The temperature was raised to 180° C. to effect drying (curing) to form first surface coat layers, followed by leaving to cool. Next, a methanol solution in which 0.3 part by weight of n-propyltrimethoxysilane was dissolved as the second surface coating agent was added to carry out wet-process coating. The temperature was raised to 70° C. to effect drying (curing) to form second surface coat layers on the first surface coat layers. Thus, the magnetic particles for charging, 27, were obtained. The weight loss on heating of the magnetic particles for charging, 27, was 0.4% by weight. Incidentally, the aluminum 9-octadecenylacetoacetate diisopropoxide was found to be insoluble in the methanol as it became cloudy.

The magnetic particles for charging, 27, showed no difference in the minor-axis length/major-axis length standard deviation before and after the surface coating, and had a volume resistivity of $5\times10^7$ Ω·cm.

Evaluation was made on the magnetic particles for charging, 27, in the same manner as in Example 41. Results obtained are shown in Table 11.

Example 47

Magnetic particles for charging, 28, were obtained in the same manner as in Example 46 except that the magnetic particles 4 were replaced with the magnetic particles 5. They showed no difference in the minor-axis length/major-axis length standard deviation before and after the surface coating, and had a volume resistivity of $4\times10^7$ Ω·cm.

Evaluation was made on the magnetic particles for charging, 28, in the same manner as in Example 41. Results obtained are shown in Table 11.

Example 48

Magnetic particles for charging, 30, were obtained in the same manner as in Example 46 except that the magnetic particles 4 Were replaced with the magnetic particles 7. They showed no difference in the minor-axis length/major-axis length standard deviation before and after the surface coating, and had a volume resistivity of $3\times10^9$ Ω·cm.

Evaluation was made on the magnetic particles for charging, 30, in the same manner as in Example 41 except that the applied DC voltage and the potential of the image-bearing member were changed to −950 V and −700 V, respectively, because of a high resistivity of the magnetic particles for charging. Results obtained are shown in Table 11.

Example 49

Magnetic particles for charging, 31, were obtained in the same manner as in Example 46 except that the magnetic particles 4 were replaced with the magnetic particles 8. They showed no difference in the minor-axis length/major-axis length standard deviation before and after the surface coating, and had a volume resistivity of $3\times10^8$ Ω·cm.

Evaluation was made on the magnetic particles for charging, 31, in the same manner as in Example 41. Results obtained are shown in Table 11.

Example 50

Magnetic particles for charging, 32, were obtained in the same manner as in Example 46 except that the magnetic particles 4 were replaced with the magnetic particles 9. They showed no difference in the minor-axis length/major-axis length standard deviation before and after the surface coating, and had a volume resistivity of $7\times10^6$ Ω·cm.

Evaluation was made on the magnetic particles for charging, 32, in the same manner as in Example 41. Results obtained are shown in Table 11.

Example 51

A stationary mixer having a stirrer and a heating means was kept at 100° C., and 100 parts by weight of the magnetic particles 9 and an ethanol solution in which 0.3 part by weight of n-octyltrimethoxysilane was dissolved as the first surface coating agent were introduced thereinto to carry out wet-process coating of the former with the latter. The temperature was raised to 120° C. to effect drying (curing) to form first surface coat layers, followed by leaving to cool. Next, an ethanol solution in which 0.3 part by weight of n-propyltrimethoxysilane was dissolved as the second surface coating agent was added to carry out wet-process coating. The temperature was raised to 70° C. to effect drying (curing) to form second surface coat layers on the first surface coat layers. Thus, the magnetic particles for charging, 33, were obtained. The weight loss on heating of the magnetic particles for charging, 33, was 0.5% by weight.

The magnetic particles for charging, 33, showed no difference in the minor-axis length/major-axis length standard deviation before and after the surface coating, and had a volume resistivity of $9\times10^6$ Ω·cm.

Evaluation was made on the magnetic particles for charging, 33, in the same manner as in Example 41. Results obtained are shown in Table 11.

Example 52

A stationary mixer having a stirrer and a heating means was kept at 100° C., and 100 parts by weight of the magnetic particles 7 and an ethanol solution in which 0.3 part by weight of n-propyltrimethoxysilane was dissolved as the first surface coating agent were introduced thereinto to carry out wet-process coating of the former with the latter. The temperature was raised to 120° C. to effect drying (curing) to form first surface coat layers, followed by leaving to cool. Next, an ethanol solution in which 0.3 part by weight of n-propyltrimethoxysilane was dissolved as the second surface coating agent was added to carry out wet-process coating. The temperature was raised to 70° C. to effect drying (curing) to form second surface coat layers on the first surface coat layers. Thus, the magnetic particles for charging, 34, were obtained. The weight loss on heating of the magnetic particles for charging, 34, was 0.5% by weight.

The magnetic particles for charging, 34, showed no difference in the minor-axis length/major-axis length standard deviation before and after the surface coating, and had a volume resistivity of $5\times10^9$ Ω·cm.

Evaluation was made on the magnetic particles for charging, 34, in the same manner as in Example 41. Results obtained are shown in Table 11. The value of Δb* was 14, which was a little higher, but within the range of no problem in practical use. This was presumably because the first and second surface coating agents n-propyltrimethoxysilane were compounds having an alkyl chain having 3 carbon atoms and because the ethanol, in which the first surface coating agent n-propyltrimethoxysilane was soluble, was used as the solvent when the second surface coat layers were formed.

Example 53

A stationary mixer having a stirrer and a heating means was kept at 100° C., and 100 parts by weight of the magnetic particles 7 and an ethanol solution in which 1.0 part by weight of n-propyltrimethoxysilane was dissolved as the first surface coating agent were introduced thereinto to carry out wet-process coating of the former with the latter. The temperature was raised to 120° C. to effect drying (curing) to form first surface coat layers, followed by leaving to cool. Next, an ethanol solution in which 1.0 part by weight of n-propyltrimethoxysilane was dissolved as the second surface coating agent was added to carry out wet-process coating. The temperature was raised to 70° C. to effect drying (curing) to form second surface coat layers on the first surface coat layers. Thus, the magnetic particles for charging, 35, were obtained. The weight loss on heating of the magnetic particles for charging, 35, was 1.7% by weight.

The magnetic particles for charging, 35, showed no difference in the minor-axis length/major-axis length standard deviation before and after the surface coating, and had a volume resistivity of $4\times10^9$ Ω·cm.

Evaluation was made on the magnetic particles for charging, 35, in the same manner as in Example 41. Results obtained are shown in Table 11. The value of Δb* was 12, which was a little higher, but within the range of no problem in practical use. This was presumably because the first and second surface coating agents n-propyltrimethoxysilane were compounds having an alkyl chain having 3 carbon atoms and because the ethanol, in which the first surface coating agent n-propyltrimethoxysilane was soluble, was used as the solvent when the second surface coat layers were formed.

Example 54

In Example 41, after the evaluation of Δb*, a character image with an image area percentage of 4% was copied on 50,000 sheets to make a running test. Results obtained are shown in Table 11. Solid yellow images were formed in a good image quality, and images having less fog were obtainable. Contamination quantity was 0.08%.

Herein, the contamination quantity refers to a weight obtained when the weight loss of magnetic particles for charging that is measured before evaluation is subtracted from the weight loss of magnetic particles for charging that is measured at temperatures of from 150° C. to 400° C. in an atmosphere of nitrogen, and expressed in percentage with respect to the sample weight (weight of magnetic particles for charging).

Example 55

In Example 47, after the evaluation of Δb*, a character image with an image area percentage of 4% was copied on 50,000 sheets to make a running test. As a result, solid yellow images were formed in a good image quality, and images having less fog were obtainable. Contamination quantity was 0.35%. Results obtained are shown in Table 11.

Example 56

In Example 48, after the evaluation of Δb*, a character image with an image area percentage of 4% was copied on 50,000 sheets to make a running test. Results obtained are shown in Table 11. Uneven photosensitive member charge potential due to a high resistivity of the magnetic particles was so great that images with much fog were formed. However, solid yellow images were good. Contamination quantity after the 50,000-sheet running was 0.10%, showing good results.

Example 57

The magnetic particles for charging, 22, were used in the charging assembly in the unit Pa of the image-forming apparatus shown in FIG. 3 and the developing assembly thereof was filled with the yellow toner and developer described previously. Similarly, the magnetic particles for charging, 22, were also used in the charging assemblies in the units Pb, Pc and Pd and the developing assemblies thereof were filled with the magenta, cyan and black toners and developers, respectively, described previously. Yellow, magenta and cyan and their secondary colors red, green and violet were outputted. As the result of a 1,000-sheet running test, good color images were obtainable from the initial stage up to 1,000-sheet running.

Comparative Example 3

A stationary mixer having a stirrer and a heating means was kept at 100° C., and 100 parts by weight of the magnetic particles 7 and an ethanol solution in which 0.3 part by weight of n-octyltrimethoxysilane and 0.3 part by weight of n-propyltrimethoxysilane were dissolved as surface coating agents were introduced thereinto to carry out wet-process coating of the former with the latter. The temperature was raised to 70° C. to effect drying (curing) to obtain magnetic particles for charging, 36. The weight loss on heating of the magnetic particles for charging, 36, was 0.4% by weight.

The magnetic particles for charging, 36, showed no difference in the minor-axis length/major-axis length standard deviation before and after the surface coating, and had a volume resistivity of $3\times10^9$ Ω·cm.

Evaluation was made on the magnetic particles for charging, 36, in the same manner as in Example 41. Results obtained are shown in Table 11. The value of Δb* was so great that any good results were not obtainable.

Comparative Example 4

A stationary mixer having a stirrer and a heating means was kept at 100° C., and 100 parts by weight of the magnetic particles 7 and an ethanol solution in which 0.6 part by weight of n-propyltrimethoxysilane was dissolved were introduced thereinto to carry out wet-process coating of the former with the latter. The temperature was raised to 70° C. to effect drying (curing) to obtain magnetic particles for charging, 37. The weight loss on heating of the magnetic particles for charging, 37, was 0.4% by weight.

The magnetic particles for charging, 37, showed no difference in the minor-axis length/major-axis length standard deviation before and after the surface coating, and had a volume resistivity of $5\times10^9$ Ω·cm.

Evaluation was made on the magnetic particles for charging, 37, in the same manner as in Example 41. Results obtained are shown in Table 11. The value of Δb* was so great that any good results were not obtainable.

Comparative Example 5

A stationary mixer having a stirrer and a heating means was kept at 100° C., and 100 parts by weight of the magnetic particles 7 and an ethanol solution in which 2.0 parts by weight of n-propyltrimethoxysilane was dissolved were introduced thereinto to carry out wet-process coating of the former with the latter. The temperature was raised to 70° C. to effect drying (curing) to obtain magnetic particles for charging, 38. The weight loss on heating of the magnetic particles for charging, 38, was 1.8% by weight.

The magnetic particles for charging, 38, showed no difference in the minor-axis length/major-axis length standard deviation before and after the surface coating, and had a volume resistivity of $5\times10^{9}$ Ω·cm.

Evaluation was made on the magnetic particles for charging, 38, in the same manner as in Example 41. Results obtained are shown in Table 11. The value of Δb* was so great that any good results were not obtainable.

Comparative Example 6

Evaluation was made in the same manner as in Example 41 except for using the magnetic particles 6 themselves as the magnetic particles for charging. Results obtained are shown in Table 11. The value of Δb* was so great that any good results were not obtainable.

Comparative Example 7

Magnetic particles for charging, 29, were obtained in the same manner as in Example 46 except that the magnetic particles 4 were replaced with the magnetic particles 6. They showed no difference in the minor-axis length/major-axis length standard deviation before and after the surface coating, and had a volume resistivity of $8\times10^{3}$ Ω·cm.

Evaluation was made on the magnetic particles for charging, 29, in the same manner as in Example 41 except that a protective resistance of 0.5 MΩ was provided between the charging assembly and the high-voltage powder source so that any pinhole leak due to a low resistance of magnetic particles was preventable. Results obtained are shown in Table 11. A phenomenon of leak ascribable to the low resistance was seen around drum pinholes in the course of reproduction of solid white images.

Comparative Example 8

In Comparative Example 7, after the evaluation of Δb*, a character image with an image area percentage of 4% was copied on 50,000 sheets to make a running test. Results obtained are shown in Table 11. At the stage where copies were taken on more than 20,000 sheets in the running test, fog began to much occur. Evaluation concerning solid yellow images showed good results. Contamination quantity at the stage of 20,000-sheet running was 0.55% by weight, which was ascribable to the fact that the minor-axis length/major-axis length standard deviation was 0.06.

As described above, the present invention can provide magnetic particles for charging, a charging member, a process cartridge and an image-forming apparatus which promise a superior charging performance. It also can provide a process cartridge and an image-forming apparatus which may cause less abrasion of the photosensitive member.

The present invention can also provide magnetic particles for charging, a charging member, a process cartridge and an image-forming apparatus which enable formation of sharp images over a long period of time. The present invention can still also provide a process for producing magnetic particles for charging which have a superior service durability, may cause less abrasion of the photosensitive member, and enable formation of full-color images stable over a long period of time.

TABLE 1

| Magnetic particles for charging | Magnetic particles | Minor-axis length/major-axis length standard deviation <5 μm | 5–20 μm | First surface coat layer: treating agent | Coating wt. (pbw) | Diluent solvent | Coating temp. (° C.) | Curing temp. (° C.) | Second surface coat layers: Treating agent | Coating wt. | Diluent solvent | Coating temp. | Curing temp. |
|---|---|---|---|---|---|---|---|---|---|---|---|---|---|
| 1 | 3 | 0.13 | 0.14 | T18 | 0.15 | toluene | 120 | 220 | N2 | 0.1 | ethanol | 70 | 170 |
| 2 | 1 | 0.05 | 0.06 | T18 | 0.15 | toluene | 120 | 220 | N2 | 0.1 | ethanol | 70 | 170 |
| 3 | 2 | 0.05 | 0.06 | T18 | 0.15 | toluene | 120 | 220 | N2 | 0.1 | ethanol | 70 | 150 |
| 4 | 1 | 0.05 | 0.06 | T18 | 0.15 | toluene | 120 | 220 | N1 | 0.1 | ethanol | 70 | 170 |
| 5 | 3 | 0.13 | 0.14 | T18 | 0.15 | toluene | 120 | 220 | N1 | 0.1 | ethanol | 70 | 150 |
| 6 | 2 | 0.05 | 0.06 | T18 | 0.15 | toluene | 120 | 220 | TN2 | 0.1 | methanol | 70 | 170 |
| 7 | 2 | 0.05 | 0.06 | S12 | 0.15 | toluene | 100 | 190 | N2 | 0.1 | ethanol | 70 | 170 |
| 8 | 3 | 0.13 | 0.14 | S8 | 0.15 | toluene | 100 | 190 | N2 | 0.1 | ethanol | 70 | 170 |
| 9 | 1 | 0.05 | 0.06 | T12 | 0.15 | toluene | 120 | 200 | N2 | 0.1 | ethanol | 70 | 150 |
| 10 | 2 | 0.05 | 0.06 | S18 | 0.15 | toluene | 100 | 190 | N1 | 0.1 | ethanol | 70 | 170 |
| 11 | 1 | 0.05 | 0.06 | S12 | 0.15 | toluene | 100 | 190 | N3 | 0.1 | ethanol | 70 | 150 |
| 12 | 1 | 0.05 | 0.06 | Ac | 0.1 | toluene | 120 | 190 | N2 | 0.1 | ethanol | 70 | 170 |
| 13 | 1 | 0.05 | 0.06 | Ac | 0.1 | toluene | 120 | 190 | N-oil | 0.1 | toluene | 100 | 150 |
| 14 | 2 | 0.05 | 0.06 | H-oil | 0.15 | toluene | 120 | 220 | N-oil | 0.1 | toluene | 100 | 150 |
| 15 | 1 | 0.05 | 0.06 | F-Ac | 0.15 | toluene | 120 | 200 | N1 | 0.1 | ethanol | 70 | 170 |
| 16 | 1 | 0.05 | 0.06 | H-oil | 0.15 | toluene | 120 | 220 | N1 | 0.1 | ethanol | 70 | 170 |
| 17 | 2 | 0.05 | 0.06 | Si-r. | 0.15 | toluene | 100 | 200 | TN2 | 0.1 | ethanol | 70 | 170 |
| 18 | 1 | 0.05 | 0.06 | T18 | 0.15 | toluene | 120 | 220 | N-oil | 0.1 | toluene | 100 | 150 |
| 19 | 2 | 0.05 | 0.06 | N2(0.10 p)-Ac(0.10 p) mix simultaneous coating. Cured at 170° C. | | | | | | | | | |
| 20 | 2 | 0.05 | 0.06 | N2(0.10 p)-T18(0.10 p) mix simultaneous coating. Cured at 170° C. | | | | | | | | | |
| 21 | 1 | 0.05 | 0.06 | Polycarbonate resin(0.20 p) was coated at 100° C., then cured at 120° C. | | | | | | | | | |

TABLE 2

| | |
|---|---|
| N1: | 3-aminopropyltriethoxysilane |
| N2: | N-(2-aminoethyl)-3-aminopropyltrimethoxysilane |
| N3: | (3-trimethoxysilylpropyl) diethylenetriamine |
| TN2: | bis[3-(trimethoxysilyl)propyl] ethylenediamine |
| S8: | octyltriethoxysilane |
| S12: | dodecyltriethoxysilane |
| S18: | octadecyltrimethoxysilane |
| T12: | isopropyltridodecylbenzenesulfonyl titanate |
| T18: | isopropoxytitanium tristearate |
| Ac: | acrylic resin |
| F-Ac: | fluorine acrylic resin |
| Si-r.: | silicone resin |
| H-oil: | silicone oil |
| N-oil: | amino-modified silicone oil |

TABLE 3

(Image Fog)

| Rank | FOG density (%) | Image evaluation |
|---|---|---|
| AA | less than 0.5 | High quality. |
| A | from 0.5 to less than 1.0 | Slight fog in an extent partly recognizable, and a good quality. |
| B | from 1.0 to less than 2.0 | Fog was recognizable, but image quality was of no problem. |
| C | more than 2.0 | Fog was conspicuous, resulting in a low image quality. |

TABLE 4

(Fine-line Reproducibility)

| Rank | Image evaluation |
|---|---|
| AA | High quality. |
| A | Good reproducibility. |
| B | A low reproducibility at some part, but being so slight as to be of no problem. |
| C | A defective reproducibility (faulty images occurred frequently). |

TABLE 5

(Toner Scatter)

| Rank | Image evaluation |
|---|---|
| AA | No toner scatter. |
| A | Toner scatter was seen at some part, but no influence on images. |
| B | Slight image fog occurred, but no problem. |
| C | Image fog occurred with progress of running (fog density: 2% or more). |

TABLE 6

(Scratches)

| Rank | Image evaluation |
|---|---|
| AA | No scratches. |
| A | Slight scratches occurred, but no influence on images. |

TABLE 6-continued (Scratches)

| Rank | Image evaluation |
|---|---|
| B | Faulty images due to scratches occurred, but were so slight as to be of no problem. |
| C | Scratches occurred seriously, resulting in a low image quality. |

TABLE 7

(Change in Tints)

| Rank | b1–b2 | Evaluation |
|---|---|---|
| AA | 5 or less | Good quality. |
| A | 5 to 10 | A small change in tints, having no influence on image quality. |
| B | 10 to 20 | Changes in tints were recognizable, but judged to be on the minimum level for practical use. |
| C | 20 or more | Changes in tints were seen, and infeasible for practical use. |

TABLE 8

| | Magnetic particles for charging | Evaluation method 1 (1) Fog | (2) Fine line | (3) Scatter | (4) Scratches | Evaluation method 2 Change in tints |
|---|---|---|---|---|---|---|
| Example: | | | | | | |
| 21 | 1 | AA | AA | AA | AA | AA |
| 22 | 5 | AA | AA | AA | AA | AA |
| 23 | 8 | AA | AA | AA | A | AA |
| 24 | 2 | AA | AA | AA | AA | AA |
| 25 | 3 | AA | AA | AA | AA | AA |
| 26 | 4 | AA | AA | AA | AA | AA |
| 27 | 6 | AA | AA | AA | AA | AA |
| 28 | 7 | AA | AA | AA | A | AA |
| 29 | 9 | AA | AA | AA | A | AA |
| 30 | 10 | AA | AA | AA | A | AA |
| 31 | 11 | AA | AA | AA | A | AA |
| 32 | 12 | A | A | AA | AA | AA |
| 33 | 13 | A | A | A | A | A |
| 34 | 14 | B | A | A | B | A |
| 35 | 15 | A | A | A | A | A |
| 36 | 16 | A | A | AA | A | A |
| 37 | 17 | B | B | A | A | A |
| 38 | 18 | A | A | A | A | AA |
| 39 | 19 | B | B | B | B | B |
| 40 | 20 | B | B | B | A | A |
| Comparative Example: | | | | | | |
| 1 | Magnetic particle 1 | B | B | C | C | C |
| 2 | 21 | B | C | C | B | B |

TABLE 9

| Magnetic particles for charging | Magnetic particles | Minor-axis length/major-axis length standard deviation <5 μm | 5–20 μm | Volume resistivity (MΩ·cm) | Weight loss on heating (wt. %) | First surface coating agent | Coating weight (pbw) | Solvent | Second surface coating agent | Coating weight (pbw) | Solvent |
|---|---|---|---|---|---|---|---|---|---|---|---|
| 22 | 4 | 0.12 | 0.14 | 20 | 0.5 | Agent 1 | 0.3 | toluene | Agent 2 | 0.3 | methanol |
| 23 | 4 | 0.12 | 0.14 | 50 | 0.5 | Agent 1 | 0.3 | toluene | Agent 6 | 0.3 | ethanol |
| 24 | 4 | 0.12 | 0.14 | 60 | 0.4 | Agent 1 | 0.3 | toluene | Agent 4 | 0.3 | ethanol |
| 25 | 4 | 0.12 | 0.14 | 60 | 0.4 | Agent 1 | 0.3 | toluene | Agent 4 | 0.3 | toluene |
| 26 | 4 | 0.12 | 0.14 | 40 | 0.3 | Agent 1 | 0.3 | toluene | Agent 4 | 0.05 | ethanol |
| 27 | 4 | 0.12 | 0.14 | 50 | 0.4 | Agent 2 | 0.3 | toluene | Agent 4 | 0.3 | methanol |
| 28 | 5 | 0.09 | 0.11 | 40 | 0.4 | Agent 2 | 0.3 | toluene | Agent 4 | 0.3 | methanol |
| 29 | 6 | 0.06 | 0.07 | 0.008 | 0.4 | Agent 2 | 0.3 | toluene | Agent 4 | 0.3 | methanol |
| 30 | 7 | 0.11 | 0.13 | 3,000 | 0.4 | Agent 2 | 0.3 | toluene | Agent 4 | 0.3 | methanol |
| 31 | 8 | 0.12 | 0.14 | 300 | 0.4 | Agent 2 | 0.3 | toluene | Agent 4 | 0.3 | methanol |
| 32 | 9 | 0.12 | 0.14 | 7 | 0.4 | Agent 2 | 0.3 | toluene | Agent 4 | 0.3 | methanol |
| 33 | 9 | 0.12 | 0.14 | 9 | 0.5 | Agent 3 | 0.3 | ethanol | Agent 4 | 0.3 | ethanol |
| 34 | 7 | 0.11 | 0.13 | 5,000 | 0.5 | Agent 4 | 0.3 | ethanol | Agent 4 | 0.3 | ethanol |
| 35 | 7 | 0.11 | 0.13 | 4,000 | 1.7 | Agent 4 | 1.0 | ethanol | Agent 4 | 1.0 | ethanol |
| 36 | 7 | 0.11 | 0.13 | 3,000 | 0.4 | Agent 5 | 0.6 | ethanol | — | — | — |
| 37 | 7 | 0.11 | 0.13 | 5,000 | 0.4 | Agent 4 | 0.6 | ethanol | — | — | — |
| 38 | 7 | 0.11 | 0.13 | 5,000 | 1.8 | Agent 4 | 2.0 | ethanol | — | — | — |

TABLE 10

| | |
|---|---|
| Coating agent 1: | Isopropoxytitanium tristearate |
| Coating agent 2: | Aluminum 9-octadecenylacetoacetate diisopropoxide |
| Coating agent 3: | n-Octyltrimethoxysilane |
| Coating agent 4: | n-Propyltrimethoxysilane |
| Coating agent 5: | n-Octyltrimethoxysilane/n-propyltrimethoxysilane |
| Coating agent 6: | Dodecyltrimethoxysilane |

What is claimed is:

1. Magnetic particles for charging which are to be rubbed against an image-bearing member on which an electrostatic latent image is to be formed, to charge the image-bearing member electrostatically; the magnetic particles for charging comprising;

magnetic particles;

first surface coat layers containing a first surface coating agent and covering the surfaces of the magnetic particles; and

TABLE 11

| | Magnetic particles used | Δb* | Running test results | Contamination quantity |
|---|---|---|---|---|
| Example: | | | | |
| 41 | Magnetic particles for charging, 22 | 2 | — | — |
| 42 | Magnetic particles for charging, 23 | 4 | — | — |
| 43 | Magnetic particles for charging, 24 | 5 | — | — |
| 44 | Magnetic particles for charging, 25 | 10 | — | — |
| 45 | Magnetic particles for charging, 26 | 5 | — | — |
| 46 | Magnetic particles for charging, 27 | 6 | — | — |
| 47 | Magnetic particles for charging, 28 | 6 | — | — |
| 48 | Magnetic particles for charging, 30 | 6 | — | — |
| 49 | Magnetic particles for charging, 31 | 6 | — | — |
| 50 | Magnetic particles for charging, 32 | 6 | — | — |
| 51 | Magnetic particles for charging, 33 | 8 | — | — |
| 52 | Magnetic particles for charging, 34 | 14 | — | — |
| 53 | Magnetic particles for charging, 35 | 12 | — | — |
| 54 | Magnetic particles for charging, 22 | — | Good on 5,000 sheets | 0.08% |
| 55 | Magnetic particles for charging, 28 | — | Good on 5,000 sheets | 0.35% |
| 56 | Magnetic particles for charging, 30 | — | Uneven potential/much fog | 0.10% |
| Comparative Example: | | | | |
| 3 | Magnetic particles for charging, 36 | 20 | — | — |
| 4 | Magnetic particles for charging, 37 | 25 | — | — |
| 5 | Magnetic particles for charging, 38 | 21 | — | — |
| 6 | Magnetic particles 6 | 30 | — | — |
| 7 | Magnetic particles for charging, 29 | 5 | — | — |
| 8 | Magnetic particles for charging, 29 | — | Slight fog after 20,000 sheets | 0.55% |

second surface coat layers containing a second surface coating agent and covering the first surface coat layers;

said magnetic particles for charging containing magnetic particles for charging which have a maximum chord length of 5 μm or larger, and the magnetic particles for charging which have a maximum chord length of 5 μm or larger having a minor-axis length/major-axis length standard deviation of 0.08 or more.

2. Magnetic particles for charging according to claim 1, wherein, said magnetic particles for charging contain magnetic particles for charging which have the maximum chord length of from 5 μm to 20 μm, and the magnetic particles for charging which have the maximum chord length of from 5 μm to 20 μm have the minor-axis length/major axis length standard deviation of 0.08 or more.

3. Magnetic particles for charging according to claim 2, wherein said minor-axis length/major-axis length standard deviation is 0.10 or more.

4. Magnetic particles for charging according to claim 1, wherein said magnetic particles for charging have an average particle diameter of from 10 μm to 200 μm.

5. Magnetic particles for charging according to claim 4, wherein said average particle diameter is from 15 μm to 30 μm.

6. Magnetic particles for charging according to claim 1, wherein at least one of said first surface coating agent and said second surface coating agent is a nitrogen-containing material or a compound containing an alkyl chain having 6 or more carbon atoms.

7. Magnetic particles for charging according to claim 6, wherein said nitrogen-containing material has an amino group.

8. Magnetic particles for charging according to claim 6, wherein said second surface coating agent is a nitrogen-containing material.

9. Magnetic particles for charging according to claim 8, wherein said nitrogen-containing material has an amino group.

10. Magnetic particles for charging according to claim 6, wherein at least one of said first surface coating agent and said second surface coating agent is a coupling agent.

11. Magnetic particles for charging according to claim 1, wherein at least one of said first surface coating agent and said second surface coating agent is a coupling agent.

12. Magnetic particles for charging according to claim 1, wherein said magnetic particles for charging have a volume resistivity of from $10^4$ Ω·cm to $10^9$ Ω·cm.

13. Magnetic particles for charging according to claim 1, wherein said image-bearing member has a charge injection layer as a surface layer.

14. A process for producing magnetic particles for charging which are to be rubbed against an image-bearing member on which an electrostatic latent image is to be formed, to charge the image-bearing member electrostatically, the process comprising the steps of:

preparing magnetic particles by pulverization;

coating the pulverized magnetic particles with a first surface coating agent to form first surface coat layers on their surfaces; and coating the magnetic particles on which the first surface coat layers have been formed, with a second surface coating agent to form second surface coat layers on the first surface coat layers, wherein said magnetic particles for charging contain magnetic particles for charging which have a maximum chord length of from 5 μm to 20 μm, and the magnetic particles for charging which have the maximum chord length from 5 μm to 20 μm have a minor-axis length/major-axis length standard deviation of 0.08 or more.

15. A process according to claim 14, wherein said minor-axis length/major-axis length standard deviation is 0.10 or more.

16. A process according to claim 14, wherein said magnetic particles for charging have an average particle diameter of from 10 μm to 200 μm.

17. A process according to claim 16, wherein said average particle diameter is from 15 μm to 30 μm.

18. A process according to claim 14, wherein at least one of said first surface coating agent and said second surface coating agent is a nitrogen-containing material or a compound containing an alkyl chain having 6 or more carbon atoms.

19. A process according to claim 18, wherein said nitrogen-containing material has an amino group.

20. A process according to claim 18, wherein said second surface coating agent is a nitrogen-containing material.

21. A process according to claim 20, wherein said nitrogen-containing material has an amino group.

22. A process according to claim 18, wherein at least one of said first surface coating agent and said second surface coating agent is a coupling agent.

23. A process according to claim 14, wherein at least one of said first surface coating agent and said second surface coating agent is a coupling agent.

24. A process according to claim 14, wherein said magnetic particles for charging have a volume resistivity of from $10^4$ Ω·cm to $10^9$ Ω·cm.

25. A charging member which is to be rubbed against an image-bearing member on which an electrostatic latent image is to be formed, to charge the image-bearing member electrostatically; the charging member comprising a magnet member having a conductor to which a voltage is to be applied, and magnetic particles for charging which are held on the magnet member by the action of magnetism;

wherein said magnetic particles for charging comprise;

magnetic particles;

first surface coat layers containing a first surface coating agent and covering the surfaces of the magnetic particles; and second surface coat layers containing a second surface coating agent and covering the surfaces of the magnetic particles covered with the first surface coat layers;

said magnetic particles for charging containing magnetic particles for charging which have a maximum chord length of 5 μm or larger, and the magnetic particles for charging which have a maximum chord length of 5 μm or larger having a minor-axis length/major-axis length standard deviation of 0.08 or more.

26. A charging member according to claim 25, wherein said magnetic particles for charging contain magnetic particles for charging which have the maximum chord length of from 5 μm to 20 μm, and the magnetic particles for charging which have the maximum chord length of from 5 μm to 20 μm have the minor-axis length/major-axis length standard deviation of 0.08 or more.

27. A charging member according to claim 26, wherein said minor-axis length/major-axis length standard deviation is 0.10 or more.

28. A charging member according to claim 25, wherein said magnetic particles for charging have an average particle diameter of from 10 μm to 200 μm.

29. A charging member according to claim 28, wherein said average particle diameter is from 15 μm to 30 μm.

30. A charging member according to claim 25, wherein at least one of said first surface coating agent and said second surface coating agent is a nitrogen-containing material or a compound containing an alkyl chain having 6 or more carbon atoms.

31. A charging member according to claim 30, wherein said nitrogen-containing material has an amino group.

32. A charging member according to claim 30, wherein said second surface coating agent is a nitrogen-containing material.

33. A charging member according to claim 32, wherein said nitrogen-containing material has an amino group.

34. A charging member according to claim 30, wherein at least one of said first surface coating agent and said second surface coating agent is a coupling agent.

35. A charging member according to claim 25, wherein at least one of said first surface coating agent and said second surface coating agent is a coupling agent.

36. A charging member according to claim 25, wherein said magnetic particles for charging have a volume resistivity of from $10^4$ Ω·cm to $10^9$ Ω·cm.

37. A charging member according to claim 25, wherein said image-bearing member has a charge injection layer as a surface layer.

38. A process cartridge which is detachably mountable on an image-forming apparatus in which an electrostatic latent image formed on an image-bearing member is rendered visible by the use of a toner and a toner image formed by rendering the electrostatic latent image visible is transferred to a transfer medium to form an image; the process cartridge comprising;

a charging means for charging the image-bearing member electrostatically by bringing a charging member into contact with the image-bearing member; the charging member comprising a magnet member having a conductor to which a voltage is to be applied, and magnetic particles for charging which are held on the magnet member by the action of magnetism; and at least one means selected from the group consisting of i) the image-bearing member on which the electrostatic latent image is to be formed, ii) a developing means for rendering the electrostatic latent image formed visible by the use of a toner, and iii) a cleaning means for removing the toner, remaining on the image-bearing member after the toner image formed by rendering the electrostatic latent image visible has been transferred to the transfer medium;

wherein said magnetic particles for charging comprise;

magnetic particles;

first surface coat layers containing a first surface coating agent and covering the surfaces of the magnetic particles; and second surface coat layers containing a second surface coating agent and covering the first surface coat layers;

said magnetic particles for charging containing magnetic particles for charging which have a maximum chord length of 5 μm or larger, and the magnetic particles for charging which have a maximum chord length of 5 μm or larger having a minor-axis length/major-axis length standard deviation of 0.08 or more.

39. A process cartridge according to claim 38, wherein said magnetic particles for charging contain magnetic particles for charging which have the maximum chord length of from 5 μm to 20 μm, and the magnetic particles for charging which have the maximum chord length of from 5 μm to 20 μm have the minor-axis length/major-axis length standard deviation of 0.08 or more.

40. A process cartridge according to claim 39, wherein said minor-axis length/major-axis length standard deviation is 0.10 or more.

41. A process cartridge according to claim 38, wherein said magnetic particles for charging have an average particle diameter of from 10 μm to 200 μm.

42. A process cartridge according to claim 41, wherein said average particle diameter is from 15 μm to 30 μm.

43. A process cartridge according to claim 38, wherein at least one of said first surface coating agent and said second surface coating agent is a nitrogen-containing material or a compound containing an alkyl chain having 6 or more carbon atoms.

44. A process cartridge according to claim 43, wherein said nitrogen-containing material has an amino group.

45. A process cartridge according to claim 43, wherein said second surface coating agent is a nitrogen-containing material.

46. A process cartridge according to claim 45, wherein said nitrogen-containing material has an amino group.

47. A process cartridge according to claim 43, wherein at least one of said first surface coating agent and said second surface coating agent is a coupling agent.

48. A process cartridge according to claim 38, wherein at least one of said first surface coating agent and said second surface coating agent is a coupling agent.

49. A process cartridge according to claim 38, wherein said magnetic particles for charging have a volume resistivity of from $10^4$ Ω·cm to $10^9$ Ω·cm.

50. A process cartridge according to claim 38, wherein said image-bearing member has a charge injection layer as a surface layer.

51. An image-forming apparatus comprising;

an image-bearing member on which an electrostatic latent image is to be formed;

a charging means for charging the image-bearing member electrostatically by bringing a charging member into contact with the image-bearing member; the charging member comprising a magnet member having a conductor to which a voltage is to be applied, and magnetic particles for charging which are held on the magnet member by the action of magnetism;

an exposure means for exposing to light the surface of the image-bearing member charged by the charging means, to form an electrostatic latent image;

a developing means for rendering the electrostatic latent image formed visible by the use of a toner to form a toner image; and a transfer means for transferring the toner image formed, to a transfer medium;

wherein said magnetic particles for charging comprise;

magnetic particles;

first surface coat layers containing a first surface coating agent and covering the surfaces of the magnetic particles; and second surface coat layers containing a second surface coating agent and covering the first surface coat layers;

said magnetic particles for charging containing magnetic particles for charging which have a maximum chord length of 5 μm or larger, and the magnetic particles for charging which have a maximum chord length of 5 μm or larger having a minor-axis length/major-axis length standard deviation of 0.08 or more.

52. An apparatus according to claim 51, wherein said magnetic particles for charging contain magnetic particles for charging which have the maximum chord length of from 5 μm to 20 μm, and the magnetic particles for charging which have the maximum chord length of from 5 μm to 20 μm have the minor-axis length/major-axis length standard deviation of 0.08 or more.

53. An apparatus according to claim 52, wherein said minor-axis length/major-axis length standard deviation is 0.10 or more.

54. An apparatus:according to claim 51, wherein said magnetic particles for charging have an average particle diameter of from 10 μm to 200 μm.

55. An apparatus according to claim 54, wherein said average particle diameter is from 15 μm to 30 μm.

56. An apparatus according to claim 51, wherein at least one of said first surface coating agent and said second surface coating agent is a nitrogen-containing material or a compound containing an alkyl chain having 6 or more carbon atoms.

57. An apparatus according to claim 56, wherein said nitrogen-containing material has an amino group.

58. An apparatus according to claim 56, wherein said second surface coating agent is a nitrogen-containing material.

59. An apparatus according to claim 58, wherein said nitrogen-containing material has an amino group.

60. An apparatus, according to claim 56, wherein at least one of said first surface coating agent and said second surface coating agent is a coupling agent.

61. An apparatus according to claim 51, wherein at least one of said first surface coating agent and said second surface coating agent is a coupling agent.

62. An apparatus according to claim 51, wherein said magnetic particles for charging have a volume resistivity of from 10Ω·cm to $10^9$ Ω·cm.

63. An apparatus according to claim 51, wherein said image-bearing member has a charge injection layer as a surface layer.

* * * * *

UNITED STATES PATENT AND TRADEMARK OFFICE

CERTIFICATE OF CORRECTION

PATENT NO. : 6,405,007 B1
DATED : June 11, 2002
INVENTOR(S) : Shuichi Aita et al.

It is certified that error appears in the above-identified patent and that said Letters Patent is hereby corrected as shown below:

Title page,
Item [56], FOREIGN PATENT DOCUMENTS,
"133569" should read -- 590133569 --;
"295115" should read -- 6-295115 --;
"317969" should read -- 6-317969 --;
"6355" should read -- 8-6355 --; and
"69149" should read -- 8-69149 --.

Column 1,
Line 34, "utilizes" should read -- utilize --; and
Line 39, "less" should read -- little --.

Column 2,
Line 44, "away of" should read -- a --.

Column 4,
Line 52, "for," should read -- for --.

Column 6,
Line 17, "member,(photosensitive" should read -- member (photosensitive --.

Column 7,
Line 35, "no" should be deleted; and
Line 52, "particles." should read -- particle. --.

Column 8,
Line 11, "$\Delta s=\Delta u\cdot v$" should read -- $\Delta s=\Delta u\cdot\Delta v$ --; and
Line 56, "the, magnetic" should read -- the magnetic" --.

Column 9,
Line 26, "contains" should read -- contain --;
Line 40, "to" should be deleted; and "reproducibility concerning" should read -- reproducibility --; and
Line 41, "yellow." should be deleted.

Column 11,
Line 53, "that" should read -- the --.

UNITED STATES PATENT AND TRADEMARK OFFICE

CERTIFICATE OF CORRECTION

PATENT NO. : 6,405,007 B1
DATED : June 11, 2002
INVENTOR(S) : Shuichi Aita et al.

It is certified that error appears in the above-identified patent and that said Letters Patent is hereby corrected as shown below:

Column 13,
Line 34, “dimethyldiethoxysilanel” should read -- dimethyldiethoxysilane --.

Column 15,
Line 4, “an” should read -- and --; and
Line 20, “and 1,590,” should be deleted.

Column 17,
Line 29, “be” should be deleted.

Column 19,
Line 21, “the Paschen’s law” should read -- Paschen’s law --; and
Line 65, “wave” should read -- vary --.

Column 21,
Line 48, “As a” should read -- A --.

Column 22,
Line 40, “a more” should read -- more --;
Line 45, “or” should read -- or a --; and
Line 53, “uniformed” should read -- made uniform --.

Column 23,
Line 45, “than, the” should read -- than the --.

Column 24,
Line 27, “a such” should read -- such --.

Column 25,
Line 5, “egg.,” should read -- e.g., --.

Column 27,
Line 12, “those” should read -- one --.

Column 28,
Line 7, “ethylene-viny” should read -- ethylene-vinyl --; and
Line 34, “lagents” should read -- agents --.

UNITED STATES PATENT AND TRADEMARK OFFICE

CERTIFICATE OF CORRECTION

PATENT NO. : 6,405,007 B1
DATED : June 11, 2002
INVENTOR(S) : Shuichi Aita et al.

It is certified that error appears in the above-identified patent and that said Letters Patent is hereby corrected as shown below:

Column 33,
Line 18, “make” should read -- make them --; and
Line 58, “shown, in” should read -- shown in --.

Column 35,
Line 19, “fine-line” should read -- fine line --.

Column 36,
Line 26, “coupling:agent” should read -- coupling agent --.

Column 38,
Line 30, “in” should be deleted.

Column 39,
Line 26, “magentic:” should read -- magnetic --.

Column 40,
Line 34, “provide” should read -- provided --; and
Line 36, “from, the” should read -- from the --.

Column 41,
Line 19, “saturated,” should read -- saturated --;
Line 25, “la” should read -- a --;
Line 42, “size:distribution” should read -- size distribution --; and
Line 63, “appropriate,” should read -- appropriate --.

Column 42,
Line 52, “ito” should read -- to --.

Column 45,
Line 64, “Were” should read -- were --.

Column 55,
Line 9, “wherein,” should read -- wherein --.

UNITED STATES PATENT AND TRADEMARK OFFICE

CERTIFICATE OF CORRECTION

PATENT NO. : 6,405,007 B1
DATED : June 11, 2002
INVENTOR(S) : Shuichi Aita et al.

It is certified that error appears in the above-identified patent and that said Letters Patent is hereby corrected as shown below:

Column 60,
Line 14, "10Ω·cm" should read -- $10^4$ Ω·cm --.

Signed and Sealed this

Twenty-fifth Day of February, 2003

JAMES E. ROGAN
*Director of the United States Patent and Trademark Office*